US010244792B2

(12) United States Patent
Rado

(10) Patent No.: US 10,244,792 B2
(45) Date of Patent: Apr. 2, 2019

(54) PERSONAL VAPORIZER

(71) Applicant: Lubby Holdings, LLC, Torrance, CA (US)

(72) Inventor: J. Christian Rado, Torrance, CA (US)

( * ) Notice: Subject to any disclaimer, the term of this patent is extended or adjusted under 35 U.S.C. 154(b) by 0 days.

(21) Appl. No.: 14/985,389

(22) Filed: Dec. 30, 2015

(65) Prior Publication Data

US 2016/0183596 A1 Jun. 30, 2016

Related U.S. Application Data

(60) Provisional application No. 62/098,197, filed on Dec. 30, 2014, provisional application No. 62/190,942, filed on Jul. 10, 2015.

(51) Int. Cl.

| | |
|---|---|
| ***A24F 47/00*** | (2006.01) |
| ***H05B 3/00*** | (2006.01) |
| ***H05B 3/46*** | (2006.01) |
| ***F22B 1/28*** | (2006.01) |

(52) U.S. Cl.

CPC ..... *A24F 47/008* (2013.01); *F22B 1/284* (2013.01); *H05B 3/46* (2013.01); *H05B 2203/016* (2013.01); *H05B 2203/021* (2013.01)

(58) Field of Classification Search

CPC ..... B05B 9/002; B05B 11/0002; H05B 3/46; H05B 2203/016; H05B 2203/021; F22B 1/284

USPC ..... 239/13, 135–136; 137/511–512; 392/395, 396–398, 401, 403–404

See application file for complete search history.

(56) References Cited

U.S. PATENT DOCUMENTS

| | | | | |
|---|---|---|---|---|
| 2,104,266 | A | 1/1938 | McCormick | |
| 3,200,819 | A | 8/1965 | Gilbert | |
| 3,725,990 | A | 4/1973 | Petersen et al. | |
| 4,947,874 | A | 8/1990 | Brooks et al. | |
| 5,353,834 | A * | 10/1994 | Schmitt | B60T 8/341 137/539.5 |
| 7,832,410 | B2 | 11/2010 | Hon | |
| 8,156,944 | B2 | 4/2012 | Han | |
| 8,186,209 | B2 * | 5/2012 | Wang | B60C 23/0408 340/442 |
| 8,365,742 | B2 | 2/2013 | Hon | |
| 8,375,957 | B2 | 2/2013 | Hon | |
| 8,393,331 | B2 | 3/2013 | Hon | |
| 8,794,231 | B2 | 8/2014 | Thorens et al. | |
| 8,915,254 | B2 | 12/2014 | Monsees et al. | |
| 9,220,303 | B2 | 12/2015 | Li et al. | |
| 9,380,811 | B2 * | 7/2016 | Chung | A24F 47/008 |

(Continued)

OTHER PUBLICATIONS

Office Action from USPTO dated Mar. 14, 2017 for related U.S. Appl. No. 15/253,664.

*Primary Examiner* — Dana Ross
*Assistant Examiner* — James Sims, III
(74) *Attorney, Agent, or Firm* — Klein, O'Neill & Singh, LLP

(57) ABSTRACT

A personal vaporizer is configured to be usable both for non-liquid vaporizing media and for liquid vaporizing media. In some embodiments an electrically conductive check valve blocks vaporizing media from leaking out of air intake apertures during periods of nonuse, and delivers electric power to a heating element during use. In some embodiments, no wick structures extend into a fluid chamber, but a wick extends from a wick holder downstream of the fluid chamber to a vaporizing chamber.

20 Claims, 20 Drawing Sheets

(56) References Cited

U.S. PATENT DOCUMENTS

| | | | | |
|---|---|---|---|---|
| 9,491,974 | B2 * | 11/2016 | DePiano | A24F 47/008 |
| 2006/0110144 | A1 * | 5/2006 | Fellows | A61L 9/037 392/395 |
| 2013/0247910 | A1 | 9/2013 | Postma | |
| 2013/0298905 | A1 | 11/2013 | Levin et al. | |
| 2014/0041655 | A1 | 2/2014 | Barron et al. | |
| 2015/0136158 | A1 * | 5/2015 | Stevens | A24F 47/008 131/329 |

* cited by examiner

PERSONAL VAPORIZER

CROSS-REFERENCE TO RELATED APPLICATION

This application claims priority to U.S. Provisional Application Nos. 62/098,197, filed Dec. 30, 2014, and 62/190,942, filed Jul. 10, 2015. The entirety of each of the priority applications is hereby v incorporated by reference.

BACKGROUND

The present disclosure relates to the field of personal vaporizers

Personal vaporizers are handheld devices that vaporize a vaporizing medium such as a liquid solution or a wax. The vapor is then inhaled by its user. A typical personal vaporizer has an atomizer having a heating element that selectively heats the medium in order to produce the vapor. A rechargeable battery is also typically employed for powering the atomizer.

Personal vaporizers for vaporizing liquid media typically include a fluid chamber that holds the liquid, and a wick that communicates liquid from the chamber to the atomizer. The liquid solution typically includes chemicals such as one or more of propylene glycol, glycerin, polyethylene glycol 400, and an alcohol. Extracted flavorings can also be included in the fluid. Electronic cigarettes are a type of personal vaporizer, and use a liquid solution that includes tobacco-derived nicotine. Personal vaporizers also can be used with liquid solutions that include one or more of various essential oils, including cannabis oil.

Personal vaporizers for vaporizing wax media typically include a bowl- or cup-shaped structure at the atomizer into which wax media can be placed. Such personal vaporizers typically do not include a fluid chamber, but instead typically include a detachable mouthpiece that can be removed to provide access to the atomizer cup.

Personal vaporizers typically include an air path so that vaporized media can be mixed with air and delivered to the user. Thus, air holes are formed in and through various structures of each vaporizer. However, in certain conditions, such as during periods of nonuse, vaporizing media may leak from the air holes.

Further, for some types of personal vaporizers it is desired to keep the profile, such as the cross-sectional area, of the vaporizer as small as possible. However, it is also desired to maximize vapor delivery. Maximizing such vapor delivery entails maximizing the lumen size of a vapor delivery tube from a vaporization chamber to the mouthpiece, while simultaneously maximizing the cross-sectional area of the wick(s) that deliver vaporizing liquid from a tank to the vaporizing chamber. The considerations of reducing device profile while simultaneously maximizing the cross-sectional area dedicated to both the vapor delivery tube and the wick(s) are often competing.

SUMMARY

There is a need in the art for a personal vaporizer that can simultaneously accommodate both liquid and wax media. There is a further need in the art for a personal vaporizer that will resist leaking, particularly during periods of nonuse. There is a still further need in the art for a personal vaporizer that can maximize both liquid delivery to the vaporizing chamber and vapor delivery from the vaporizing chamber to the mouthpiece while minimizing the cross-sectional profile of the device.

In accordance with one embodiment, the present specification provides a personal vaporizer, comprising: an atomizer module comprising a bowl and a coil arranged in or adjacent the bowl, the bowl configured to accept a wax having an essential oil; a battery assembly, the atomizer module connectable to the battery assembly so that actuation of the battery delivers electrical energy to the coil, causing the coil to heat and vaporize a wax that may be in the bowl; and a tank module selectively attachable to the atomizer module so that the atomizer module is disposed between the tank module and the battery assembly, the tank module comprising a fluid tank configured to contain a vaporizing liquid therewithin, and to deliver a portion of the vaporizing liquid to a vaporizing chamber adjacent the coil; wherein a wax placed in the atomizer module bowl and a vaporizing liquid from the fluid module can be simultaneously vaporized by the coil so as to form a combined vapor by simultaneously vaporizing both the wax and the vaporizing liquid.

In accordance with another embodiment, the present specification provides a personal vaporizer, comprising: a tube comprising a fluid chamber and a vapor passage extending through the fluid chamber; an atomizer module comprising a bowl having an upper edge, a coil being arranged in or adjacent the bowl, the bowl being configured to accept a vaporizing solution inside the tank; a check valve comprising an insulator housing, a conductive shell inside the insulator housing, and a sealing mechanism inside the conductive shell, the sealing mechanism providing a seal inside the conductive shell; and a battery assembly, the atomizer module connectable to the battery assembly through the check valve so that actuation of the battery delivers electrical energy to the coil, causing the coil to heat and vaporize the vaporizing solution.

Some embodiments additionally comprise one or more slots formed through a side wall of the bowl.

In additional embodiments, the sealing mechanism comprises a ball and a spring.

In further embodiments, the bowl has a first wire hole and a second wire hole extending through a bottom wall of the bowl and a second channel extending transversely from the second wire hole. In some such embodiments, the coil is a heating element having a first connection and a second connection, the first connection extending through the first wire hole and contacting the conductive shell, and the second connection extending through the second wire hole and the channel and spaced away from the conductive shell.

In accordance with another embodiment, the present specification provides a personal vaporizer, comprising: an atomizer module comprising a bowl and a heat element arranged in or adjacent the bowl, a vaporizing chamber defined in the bowl adjacent the heat element; a tank module selectively attachable to the atomizer module, the tank module comprising a fluid tank configured to contain a vaporizing liquid therewithin, the fluid tank comprising a bottom wall having at least one fluid delivery hole extending therethrough; a wick holder supporting a wick and defining a fluid receiver, the fluid receiver in communication with the at least one fluid delivery hole, the wick configured to communicate vaporizing fluid from the fluid receiver to the vaporizing chamber; and a vapor tube extending through the fluid chamber and defining a vapor passage that is separated from the fluid in the fluid chamber; wherein vapor from the vaporizing chamber is directed through the vapor passage.

In some embodiments, a cross-sectional area of the wick is greater than a cross-sectional area of the vapor passage.

In further embodiments, a combined cross-sectional area of all of the at least one fluid delivery holes is less than a cross-sectional area of the vapor passage.

DESCRIPTION

Figure 2:
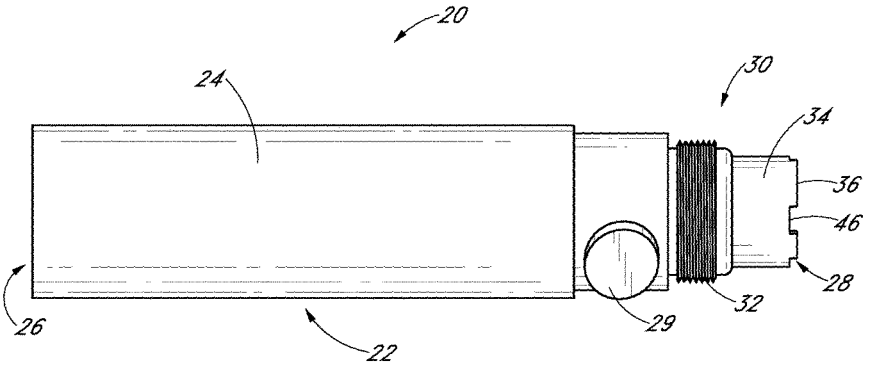
FIG. 2 is a side view of the battery assembly of FIG. 1.
Figure 1:
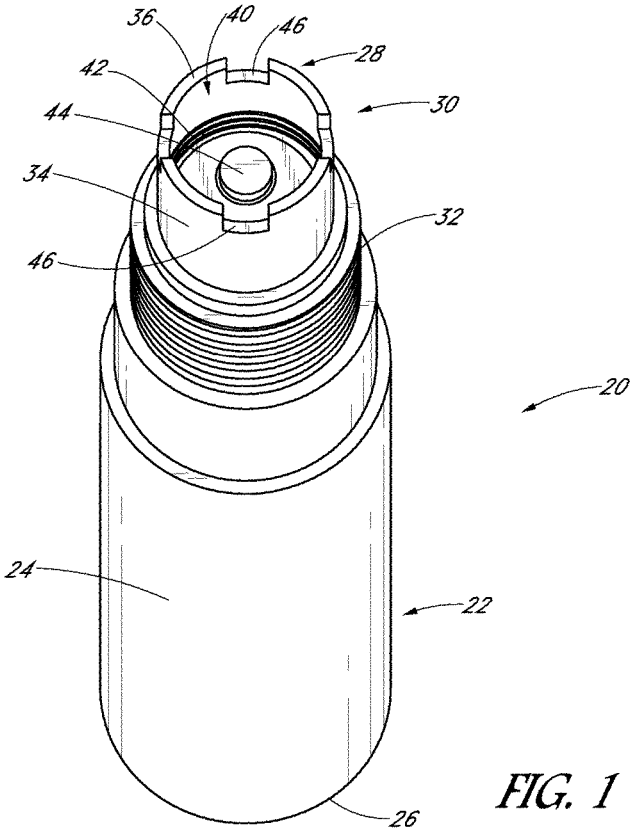
FIG. 1 is a perspective view of a battery assembly for use in some embodiments.

With initial reference to FIGS. 1 and 2, an embodiment of a battery assembly 20, or battery pack, for a personal vaporizer is illustrated. Certain features of the illustrated battery assembly 20 are typical of battery assemblies currently available on the market. For example, the battery assembly 20 may include a rechargeable battery, such as a lithium-ion battery, enclosed within a battery casing 22. The battery casing 22 may include an elongated body 24 that extends from a base or distal end 26 to a top or proximal end 28. An electronic controller may also be included within the casing 22 to control voltage, current, timing and the like. A button 29 may be provided for selectively actuating electricity delivery from the battery 20 to the atomizer. In some embodiments, the button 29 can include a light that indicates when power is being delivered.

With continued reference to FIGS. 1 and 2, at and adjacent the proximal end 28 of the battery assembly 20, the battery casing 22 defines a mount boss 30. The mount boss 30 includes connecting structures for connecting vaporizing structures, such as atomizers and fluid chambers, to the battery. The elongated body 24 is disposed distally of the mount boss 30. In some embodiments, the body 24 may include a decorative coating or sleeve that is configured to enhance the look of the vaporizer. For example, the body 24 may come in many different colors and/or have one or more unique and aesthetically pleasing surface treatments. Some embodiments may include a decorative sleeve that is selectively removable.

In the illustrated embodiment, the battery assembly mount boss 30 comprises an externally threaded portion 32 adjacent the decorative body 24. Preferably, the externally threaded portion 32 has a diameter somewhat smaller than a diameter of the decorative body 24. An extension 34 extends in a proximal direction from the externally threaded portion 32, preferably terminating in a top or proximal surface 36. As best shown in FIG. 2, the extension 34 preferably is tubular, defining a mount cavity 40 therewithin and having internal threads 42. Preferably, a diameter of the tubular extension 34 is less than the diameter of the externally threaded portion 32. A battery contact 44 is disposed within the tubular extension 34 at the base of the mount cavity 40. As shown, preferably a plurality of air intake slots 46 are formed in the extension at and adjacent the top surface.

As noted above, one or more vaporizing structures are attachable to the battery mount boss 30. Such vaporizing structures typically include an atomizer and a fluid chamber, which can be provided as separate pieces or combined as a single structure. The vaporizing structures can be of various styles, sizes, and configurations. For example, in some embodiments, the atomizer and fluid chamber are provided as one prefabricated cartridge. In some embodiments, such cartridges are disposable. In some embodiments, the fluid chamber is refillable so that the cartridges are reusable. In other embodiments, the atomizer and fluid chamber are separately formed and selectively attachable and detachable from one another.

Vaporizing structures can also be attached to the battery assembly 20 in various ways. In some embodiments, an atomizer can threadingly engage the external threads 32 of the battery mount boss 30. In other embodiments, an atomizer may threadingly engage the internal threads 42 of the mount cavity extension 40. Preferably, a pin or other elongated contact extends into the mount cavity 40 to engage the battery contact 44 so as to communicate power from the battery 20 to the atomizer. Additional embodiments can employ non-threaded connection structures such as detents, friction fits, J-locks, and the like.

Figure 3:
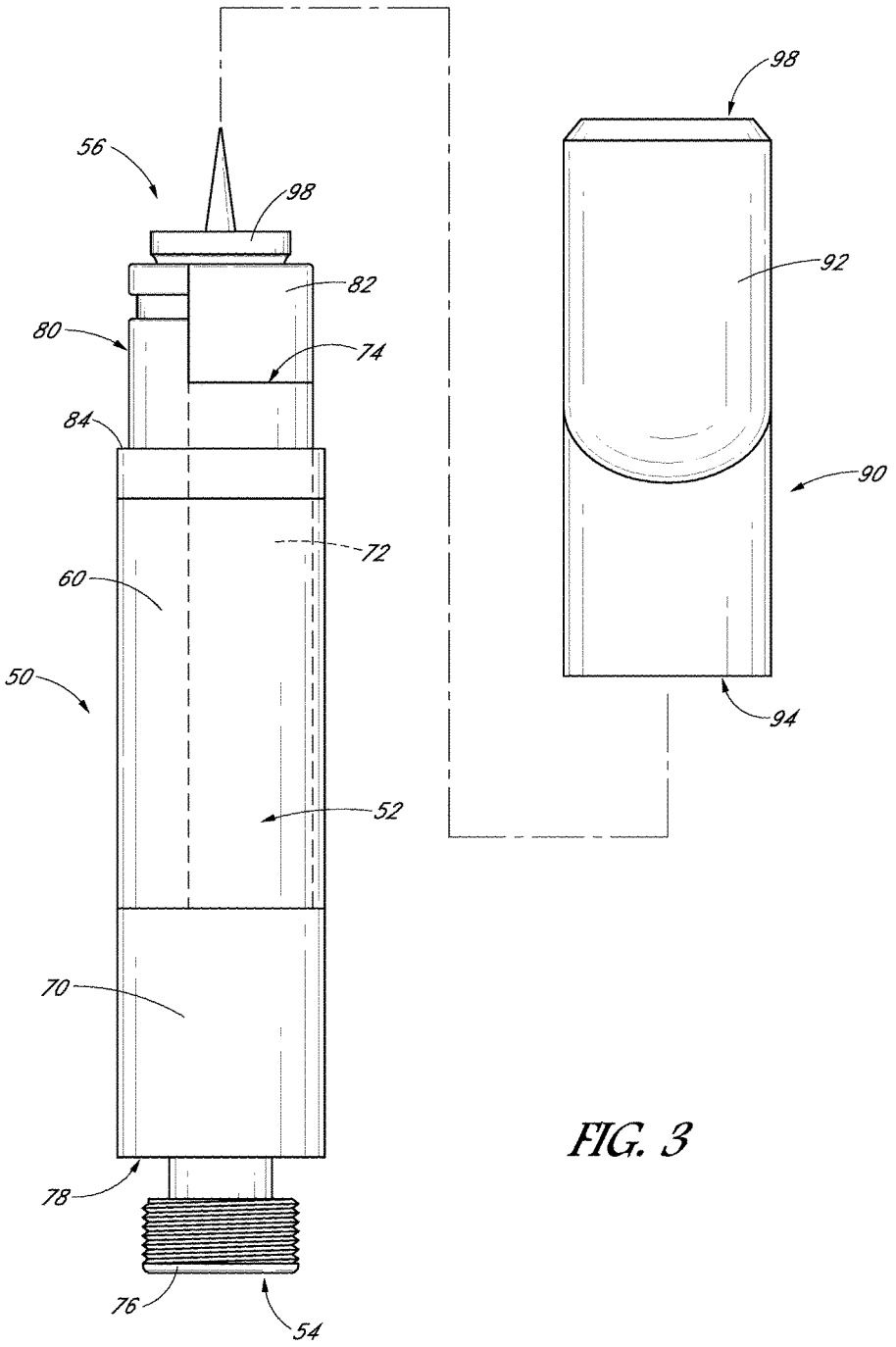
FIG. 3 is a side view of a vaporizing structure and mouthpiece in accordance with one embodiment.

With reference next to FIG. 3, one embodiment of a cartridge 50 is illustrated. Such a cartridge 50 can be obtained from PenVape, and is sold under the trademark Indica. The illustrated cartridge 50 comprises an elongated cartridge body 52 that extends from a distal or battery end 54 to a top or proximal end 56. The body 52 includes a fluid chamber 60 configured to hold a vaporizing medium such as a liquid solution comprising essential oils. The illustrated chamber 60 is made of a polymer material that is preferably at least partially transparent so that a user can see the level of essential oils remaining within the fluid chamber 60. An atomizer 70 is provided at and adjacent the distal end 54, which atomizer 70 is operatively connected to the fluid chamber 60. In the illustrated embodiment, the atomizer 70 comprises a coil (not shown) constructed of a durable, electrically-conductive material, such as titanium or another metal, which coil generates heat when subjected to an electric current. A vaporization chamber is defined between the fluid chamber 60 and the atomizer coil. In some embodiments, a wick communicates liquid from the fluid chamber 60 to the vaporization chamber. Preferably, an elongated vapor passage 72 is formed adjacent the fluid chamber 60 and extends from the vaporization chamber to a vapor outlet 74 that is formed proximal of the fluid chamber 60.

With continued reference to FIG. 3, the illustrated atomizer 70 includes a battery connector pin 76 extending distally from a terminal surface 78 of the atomizer 70. The illustrated battery connector pin 76 is externally threaded. Air intake holes (not shown) are formed through the terminal surface 78. During use, air is drawn through the air intake holes and through the atomizer 70 into the vaporization chamber, where it is mixed with atomized fluid to form a vapor. The vapor exits the vaporization chamber through the vapor channel 72 and is exhausted through the vapor outlet 74.

The proximal end 56 of the cartridge 50 includes a mouthpiece engagement portion 80 that has a reduced diameter relative to a diameter of the elongated body 52 in the chamber 60 and/or atomizer 70 portions. In the illustrated embodiment, the vapor outlet 74 opens within this mouthpiece engagement portion 80. In the illustrated embodiment, a recessed portion 82 of the outer wall in the mouthpiece engagement portion 80 is provided, and the vapor outlet 74 is formed adjacent the recessed portion 82. As such, the vapor outlet 74 is directly aligned with the flow path of vapor moving through the vapor channel 72.

Continuing with reference to FIG. 3, a mouthpiece seat 84 is defined on the cartridge 50. At the mouthpiece seat 84, the diameter of the cartridge 50 abruptly changes from that of the chamber 60 to that of the mouthpiece engagement portion 80. A mouthpiece 90 can be placed atop the cartridge 50. The mouthpiece 90 preferably includes an elongated tubular body 92 defining a lumen, and extends from a base 94 to an outlet end 96. In the illustrated embodiment, the base 94 of the mouthpiece 90 fits over the mouthpiece engagement portion 80 of the cartridge 50, and the base 94 of the mouthpiece 90 engages and rests upon the mouthpiece seat 84 of the cartridge 50.

In the illustrated embodiment, a removable fill cap 98 is disposed at the proximal/mouthpiece end 56 of the cartridge 50. The removable fill cap 90 can be removed so as to provide access to the fluid chamber 50 so that liquid or flavorings can be selectively added to the chamber.

Figure 4:
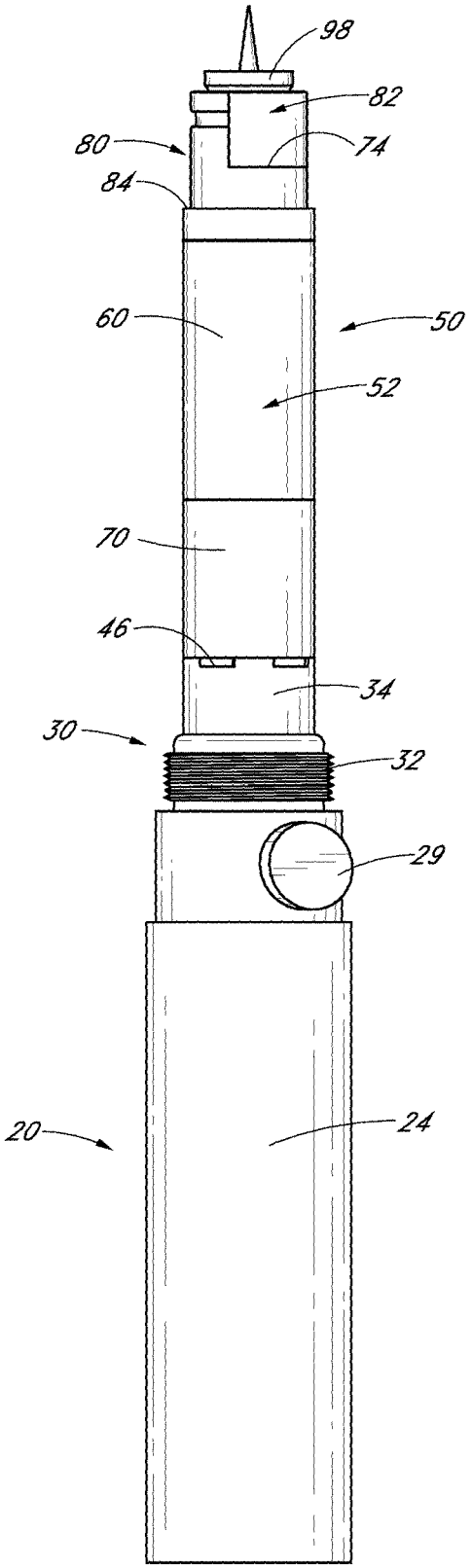
FIG. 4 is a side view of a personal vaporizer comprising the vaporizing structure of FIG. 3 attached to the battery assembly of FIG. 1.

With additional reference to FIG. 4, the cartridge 50 can be mounted to a typical battery assembly 20 so that the cartridge 50 functions as the vaporizing structure for the illustrated embodiment of a personal vaporizer. In the illustrated embodiment, the externally-threaded battery connector pin 76 is advanced into the battery mount cavity 40 and threaded with the internal threads 42 of the battery mount boss extension 34. The cartridge 50 is threadingly advanced so that the battery connector pin 76 engages the battery connector 44 of the battery assembly 20, and the terminal surface 78 of the atomizer 70 engages and sits upon the top surface 36 of the battery mount boss 30. The air intake slots 46 of the mount boss 30 enable the cartridge's air intake holes to communicate with the surrounding atmosphere.

Additional details and structure related to the cartridge are discussed in Applicant's copending application Ser. No. 14/927,355, entitled CARTRIDGE COVER FOR PERSONAL VAPORIZER, filed Oct. 29, 2015, the entirety of which is incorporated by reference herein.

In use, the user inserts the mouthpiece 90 into his mouth, presses the battery button 29, and draws a breath. Pressing the button 29 triggers the atomizer 70 to heat liquid provided to the vaporization chamber from the fluid chamber 60, thereby vaporizing the liquid in the vaporizing chamber. By drawing a breath, or taking a pull, through the mouthpiece 90, the user pulls air through the air intake slots 46 of the battery mount boss extension 34 into the mount cavity 40 and through the air intake holes of the cartridge atomizer 70. The air further flows into the vaporization chamber and is mixed with the vaporized liquid, forming a vapor. The vapor then flows through the vapor channel 72 and through the vapor outlet 74 into the mouthpiece 90, which directs it into the user's mouth and lungs.

Figure 5:
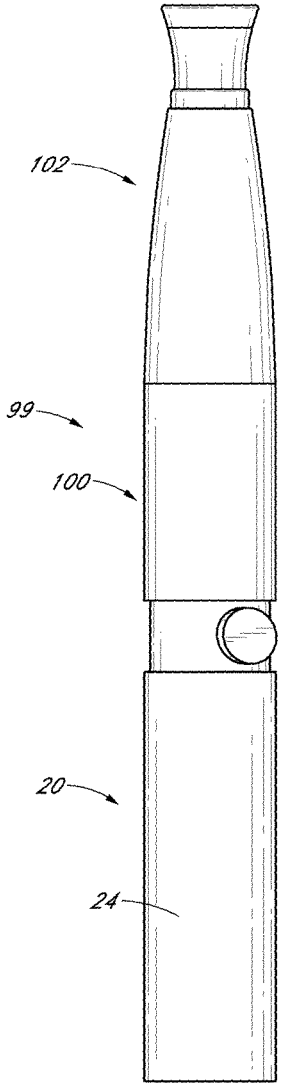
FIG. 5 is a side view of an embodiment of a personal vaporizer having a modular construction.
Figure 6:
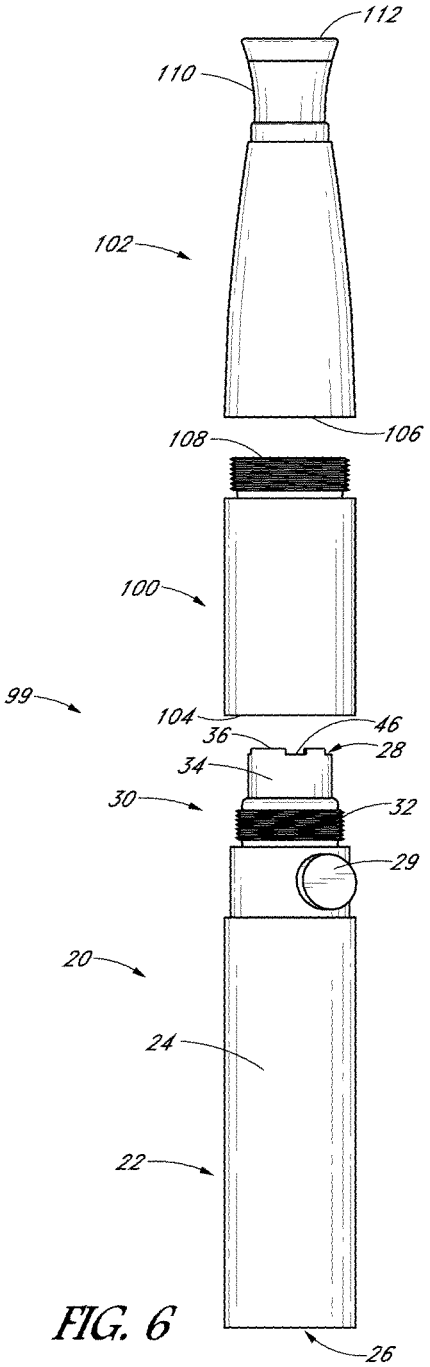
FIG. 6 is an exploded view of the personal vaporizer of FIG. 5.

With reference next to FIGS. 5 and 6, one embodiment of a personal vaporizer 99 comprises an atomizer module 100 and a mouthpiece module 102 that are threadingly attachable to one another. As shown, the atomizer module 100 has a distal end 104 that is threadingly attachable to the mount boss 30 of the battery 20 so that, as in the embodiment discussed above, electric power can be provided to the atomizer. A distal end 106 of the mouthpiece module 102 is threadingly attachable to and detachable from a proximal end 108 of the atomizer module 100. The mouthpiece module 102 preferably is tubular, delivering vapor generated in the atomizer module 100 to and through a mouthpiece 110 at its proximal end 112 for delivery to the user.

In the illustrated embodiment, a user gains access to the atomizer by detaching the mouthpiece module 102. The user may then deliver vaporizing media, such as a wax, through the open proximal end 108 of the atomizer module 100 and into a bowl-shaped structure (not shown). The user preferably replaces the mouthpiece module 102 in order to use the personal vaporizer 99. A vaporizing chamber is defined in the atomizer above the bowl and, in some embodiments, in at least part of the mouthpiece module. Notably, in this embodiment, there is no tank for storing a liquid vaporizing medium. As such, the illustrated embodiment is configured for use vaporizing non-liquid (i.e., wax) vaporizing media that is manually delivered to the vaporizing chamber by the user, in contrast with, for example, liquid media that can be automatically delivered from a storage structure such as a tank to the vaporizing chamber (such as via a wick).

Figure 7:
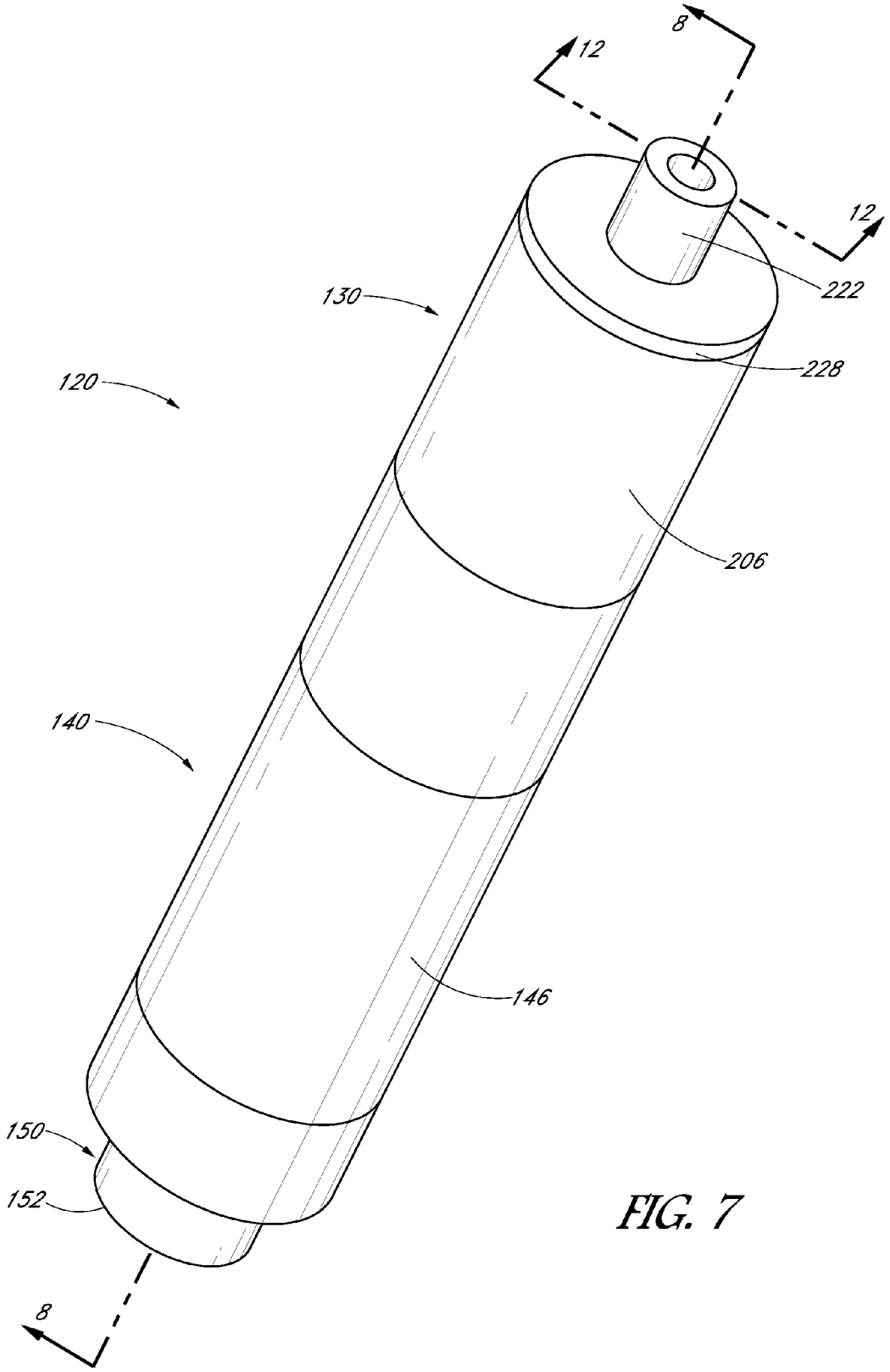
FIG. 7 is a perspective view of a vaporizing structure in accordance with another embodiment.
Figure 8:
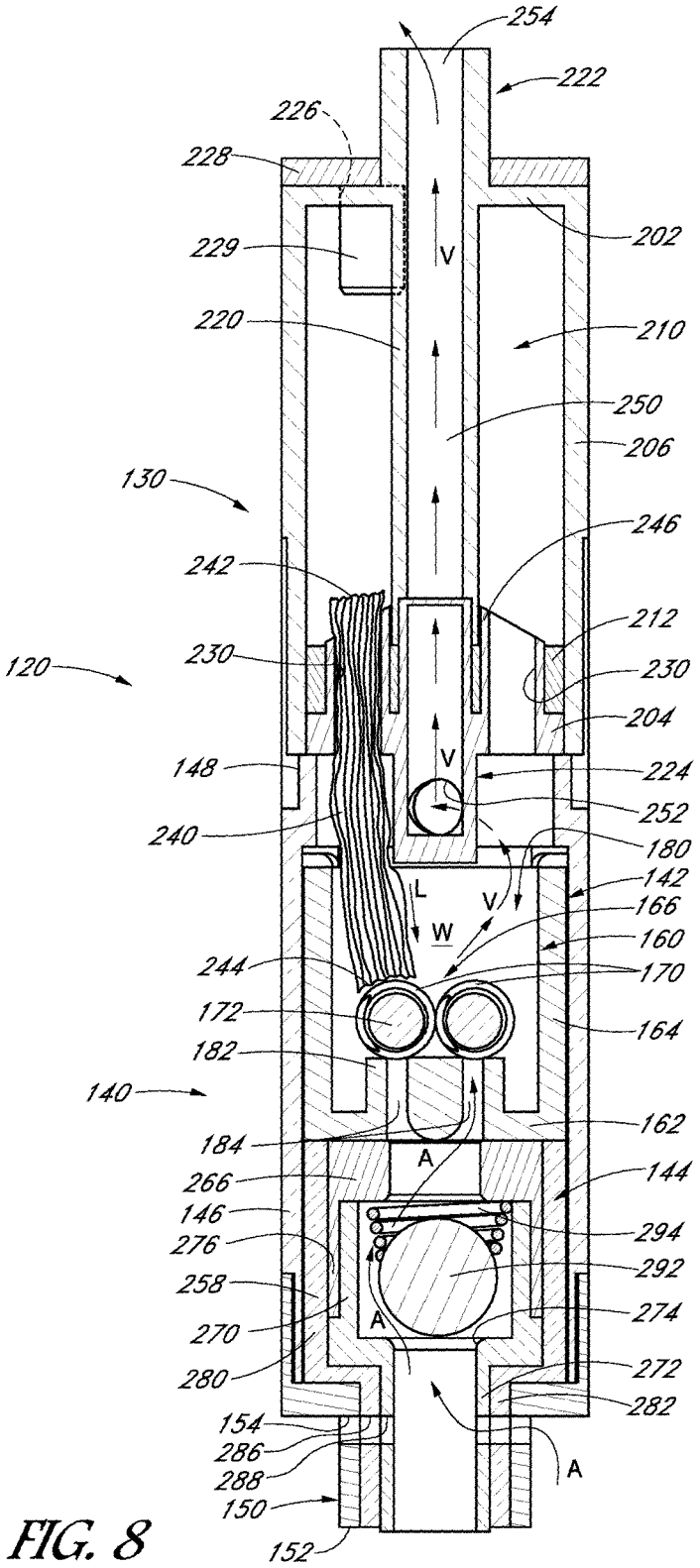
FIG. 8 is a cross-sectional view taken along lines 8-8 of FIG. 7.

With reference next to FIG. 7, an embodiment of a hybrid vaporizing structure 120 is shown. The illustrated hybrid vaporizing structure can be attached to a battery assembly 20 so as to be used as a personal vaporizer. In this embodiment, the vaporizing structure 120 comprises a tank module 130 and an atomizer module 140 that are selectively detachable from one another. FIG. 8 is a cross-sectional view of the vaporizing structure 120 of FIG. 7. As will be discussed in more detail below, the hybrid vaporizing structure is usable with liquid vaporizing media as well as non-liquid (i.e., wax) vaporizing media, both separately and simultaneously.

Figure 9:
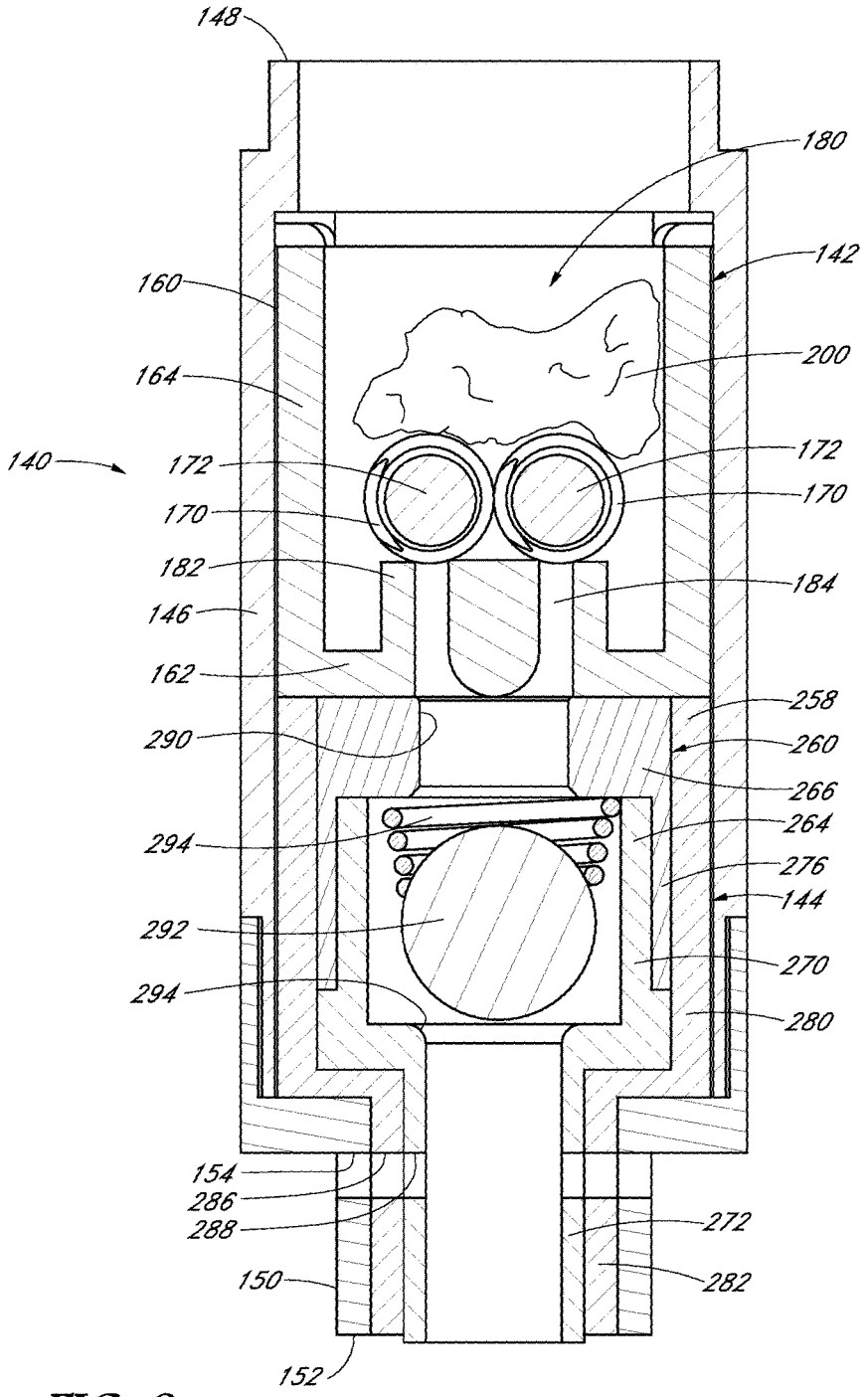
FIG. 9 is a close-up view of the atomizer module of the structure of FIG. 8, depicting a wax media disposed in an atomizer cup.

With additional reference to FIG. 9, the atomizer module 140 comprises an atomizer 142 and a check valve 144 enclosed within an atomizer module housing 146. The atomizer housing 146 comprises a proximal end 148 that preferably is threaded so as to be selectively attachable to the tank module 130. A pin 150 at a distal end 152 of the atomizer housing 146 is configured to attach to the battery mount boss 30. In the illustrated embodiment the pin 150 is configured to attach to the internal threads 42 in the mount cavity 40 of the battery mount boss 30. Air passages 154 are formed through the pin. Thus, when the atomizer module 146 is attached to the battery assembly 20, air can flow through the battery slots 46 and the air passages 154 and into the atomizer module 140.

Figure 10A:
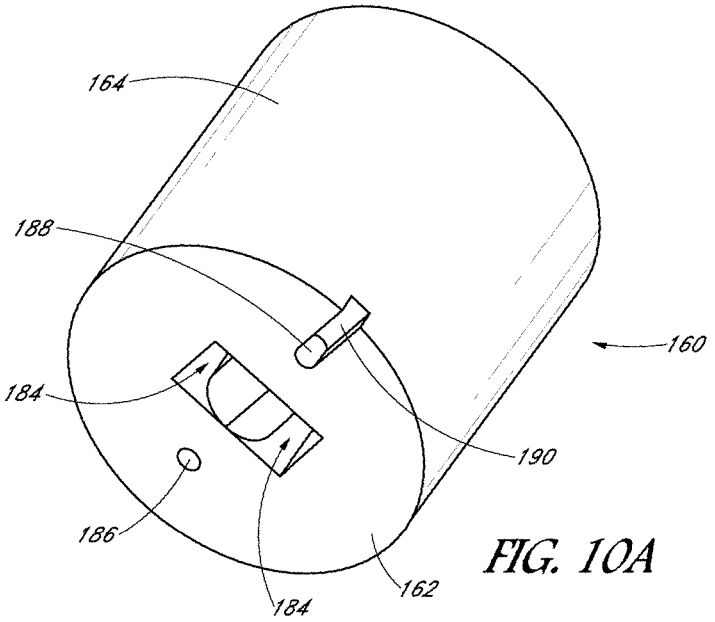
FIG. 10A is a perspective view of an atomizer cup according to one embodiment.
Figure 10B:
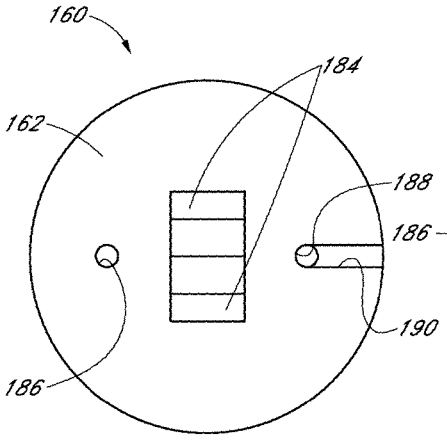
FIG. 10B is a bottom view of the atomizer cup of FIG. 10A.
Figure 10C:
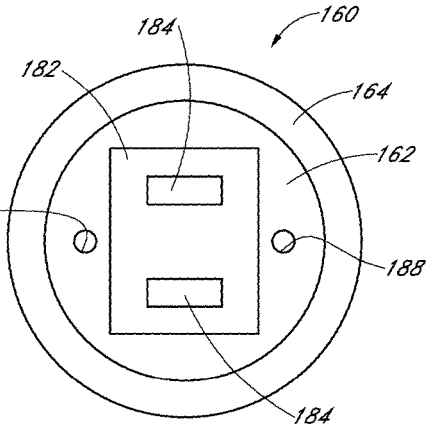
FIG. 10C is a top view of the atomizer cup of FIG. 10A.

With continued reference to FIGS. 8 and 9, and additional reference to FIGS. 10A-C, the atomizer 142 preferably is a skillet-style atomizer comprising a cylindrical bowl- or cup-shaped container, or bowl, defining bottom and side walls 162, 164 and being open at the top. Preferably, the bowl 160 is an insulator, and can be made of an insulator material such as a ceramic. A heating element 166 is contained within the bowl 160. In the illustrated embodiment the heating element 166 comprises a pair of wire coils 170 wrapped about transversely-extending insulating cores 172, or wicks. The wire coils 160 can be constructed of a durable, electrically-conductive material such as a metal (such as titanium, kanthal, or nichrome) that provides durability and electrical conduction to selectively power the atomizer 142. A vaporizing chamber 180 is defined within the bowl 160, above and around the coils 170. When the vaporizing structure 120 is attached to a battery assembly 20, the coils 170 are electrically connected to the battery and, when energized, vaporizing media at or adjacent the coils will be atomized/vaporized.

In some embodiments, a single wire can be used to create both of the coils. In additional embodiments, each coil is formed by its own wire. Of course, additional embodiments may employ only one, or more than two, coils. Also, it is to be understood that other embodiments may employ other types of heating element structures, including electricity-based and/or gas-based structures.

A raised foundation 182 extends upwardly from the bottom wall 162, and the coils 170 are positioned atop the raised foundation 182. Air slots 184 extend through the raised foundation 182. In the illustrated embodiment two air slots 184 are formed, and each air slot aligns with a respective one of the coils so as to deliver air flow directly to the respective coil.

First and second wire holes 186, 188 extend through the bottom wall 162 of the bowl 160. A channel 196 is formed on the distal surface of the bottom wall 162 of the bowl 160, and extends from the second wire hole 188 to a side of the bowl 160. A first end portion 192 of the coil wire extends through the first wire hole 186, and a second end portion 194 of the coil wire extends through the second wire hole 188 and through the channel 190. As will be discussed below, electrical energy from the battery 20 can be applied across the first and second wire portions 192, 194 to energize the coil. As shown, the wire holes 186, 188 are at opposite sides of the raised foundation 182. It is to be understood, however, that the wire holes can be located anywhere along the bottom wall or, in other embodiments, side wall of the bowl.

With continued reference specifically to FIG. 9, the illustrated embodiment is particularly suited for non-liquid vaporizing media such as a wax 200, which is depicted in the vaporizing chamber in FIG. 9. In order to place such wax 200 in the vaporizing chamber, a user can remove the tank module 130 from the atomizer module 140 and then deposit the wax 200 through the proximal opening and into the bowl 160.

With continued reference to FIG. 9, the tank module 130 comprises a tank top wall 202, tank bottom wall 204, and cylindrical outer wall 206 that cooperate to define a fluid chamber 210, or tank. The fluid chamber 210 is configured to hold a liquid solution such as a vaporizing solution comprising essential oils. A seal 212 adjacent the tank bottom wall 204 is configured to sealingly engage the outer wall 206. The outer wall in the illustrated embodiment can be made of a glass or polymer material that preferably is at least partially transparent so that a user can see the level of essential oil-based vaporization liquid remaining within the fluid chamber.

A vapor tube 220 extends generally axially through the fluid chamber 210, extending through the tank top wall, through the fluid chamber 210 and through the tank bottom wall 204. As such, a proximal portion 222 of the vapor tube 220 extends proximally from the tank top wall 202 and a distal portion 224 of the vapor tube 220 extends distally from the tank bottom wall 204. Preferably, fluid in the fluid chamber 210 is isolated from the vapor tube 220.

The tank 210 can have an opening 226 through the top wall 202 through which vaporizing solution can be added to the fluid chamber. A tank cap 228 can be removably placed atop the top wall of the tank. Preferably, a plug 229 extending from the tank cap 228 can be fit into and through the tank opening 226 so as to removably seal the opening. The cap 228 and plug 229 can be made of an elastomeric material such as silicone rubber.

Figure 12:
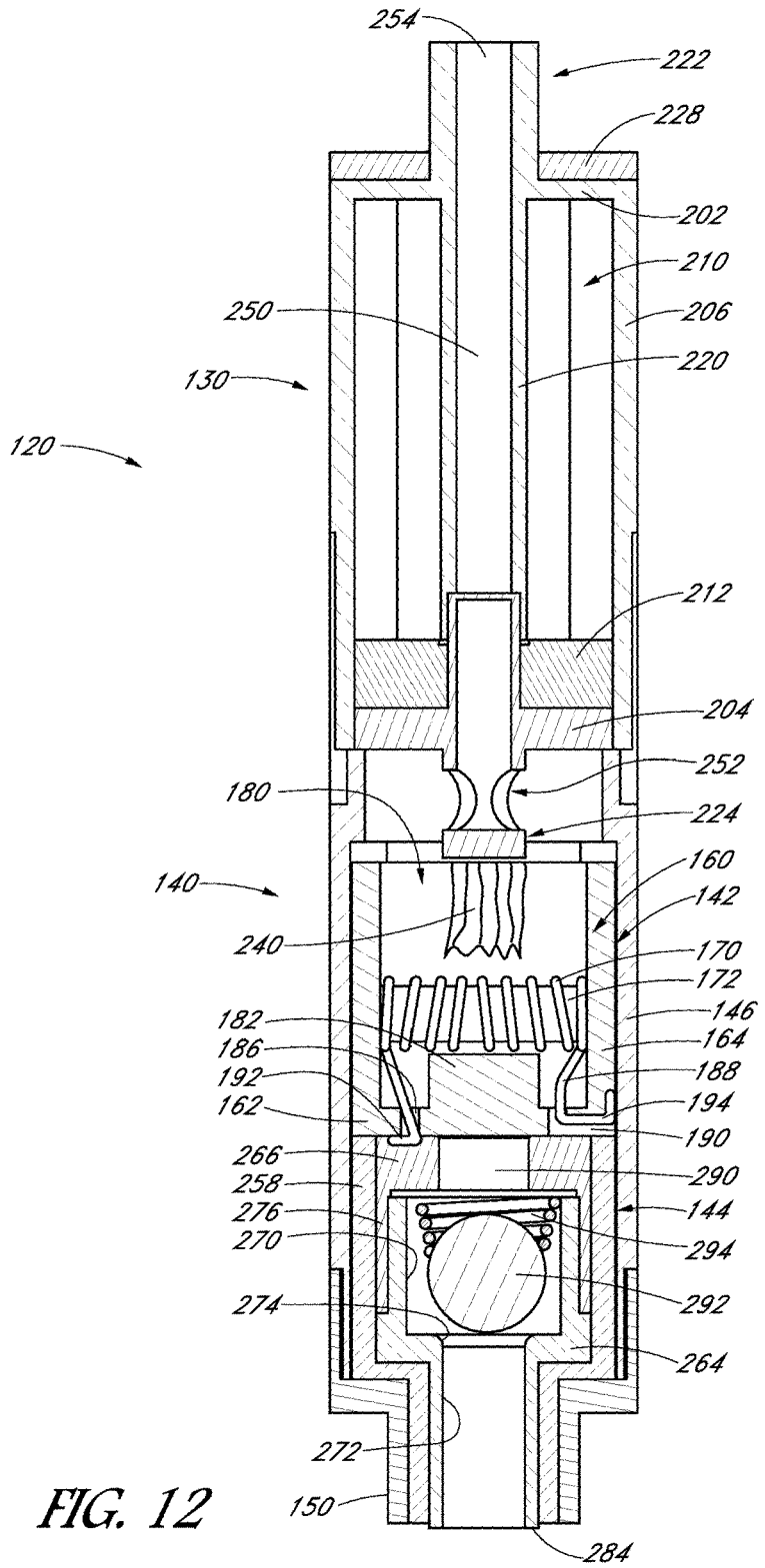
FIG. 12 is a cross-sectional view taken along line 12-12 of FIG. 7.

With continued reference to FIGS. 9 and 12, one or more fluid delivery tubes 230 (two in the illustrated embodiment) are formed through the tank bottom wall 204 to communicate the fluid chamber 210 with the vaporizing chamber 180. A wick 240 (shown in only one of the fluid delivery tubes) can be disposed in each of the fluid delivery tubes 230. A proximal end 242 of the wick 240 extends into the fluid chamber 210 and a distal end 244 of the wick 240 extends into the vaporizing chamber 180, terminating at or adjacent the heating element 166. The wicks 240 can deliver a controlled amount of vaporizing solution from the tank to the atomizer through capillary action, gravity, pressure differential between the tank and the vaporizing chamber, and other forces. In the illustrated embodiment, wick supports 246 comprise elongated portions of the fluid delivery tubes 230 that accommodate and support the wicks.

The vapor tube 220 has a vapor passage 250 or lumen that extends from the proximal portion 222 of the vapor tube 220 to the distal portion 224 of the vapor tube 220 and does not communicate with the fluid chamber 210. As shown in FIGS. 8 and 12, the distal portion 224 of the vapor tube 220 extends into the atomizer module 140 so as to be within and/or in communication with the vaporizing chamber 180. An inlet opening 252 is provided in the distal portion 222 so that the vapor passage 250 can receive vapor generated in the vaporizing chamber 180. In the illustrated embodiment, two inlet openings 252 are provided through a side wall of the vapor tube 220. An outlet of the vapor passage is defined at the proximal portion of the vapor passage. In the illustrated embodiment, the outlet 254 is aligned with an axis of the vapor passage 250. If desired, a mouthpiece can be connected to the proximal portion 224 of the vapor tube 220 so that the vapor passage 250 will open into the mouthpiece.

In some examples, the proximal portion 222 can form a mouthpiece for a user to pull vapor from the vaporizing chamber through the vapor tube. In other examples, the proximal portion can be externally threaded and/or provided with a detent structure so that a separately-formed mouthpiece can be releasably attached. When a mouthpiece is attached to the proximal portion, the elastomeric cap can be squeezed against the tank top wall to provide an additional seal for the tank opening. Also, the cap can be elastically compressible, behaving as a lock washer for the mouthpiece.

With continued reference to FIGS. 7-10 and 12, in use, a user can place a vaporizing wax media 200 in the bowl 160 of the atomizer module 140 and then attach the tank module 130, which can be filled with a vaporizing liquid, to the atomizer module 140. When the battery button is actuated, a portion of the wax 200 in the bowl 160 is vaporized. Simultaneously, a portion of the vaporizing solution that is delivered to the heating element 160 via the wick 240 is also vaporized. As the user draws a breath through the mouthpiece, the vaporized wax and solution is combined with air to form a vapor that is delivered from the vaporizing chamber 180 through the vapor tube 220 and mouthpiece and into the user's lungs. As such, the present device enables a user to simultaneously vaporize a non-liquid vaporizing media (i.e., the wax) and a liquid vaporizing solution, and to mix the vapors and deliver the combination vapor to the user.

Waxes tend to provide a vapor having a relatively high concentration of the essential oils entrained within the wax, and thus provide a highly concentrated vapor. However, a bowl of wax tends to be fully vaporized after just a few pulls. Liquid solutions tend to provide a vapor having a lower concentration of essential oils, and thus provides a less concentrated vapor. However, a tank can store a relatively large volume of solution, and thus a tank of solution tends to last a relatively long time.

By enabling simultaneous vaporization of both wax and liquid solution, and by combining the vapors and delivering the combined vapors to the user, the present embodiment enables a higher volume of essential oils per user pull than has been previously available. Additionally, various blends of waxes and liquid solutions can now easily be enjoyed.

Still further, due to the modular nature of the device, tank modules and atomizer modules can easily be detached, switched out and reattached, enabling the user to easily and quickly switch between flavors and liquid solution types. For example, a user may have several tank modules, each of which is filled with a different flavor or type of liquid solution. The user can quickly and easily switch between these tank modules as desired. Also, the tank modules do not need to have their own atomizer; thus, individual tank modules can be relatively inexpensive and easy to maintain.

As discussed above, often waxes only last a limited number of pulls before the bowl of wax is exhausted. However, liquid solutions tend to last much longer due to the ability to use a storage tank. Thus, the current configuration allows a user to have several concentrated pulls in which both wax and liquid solution are vaporized simultaneously. However, after the wax is exhausted, the user may continue to use the device without further adjustment for pulls that provide only vaporized liquid from the tank.

Figures 11A, 11B:
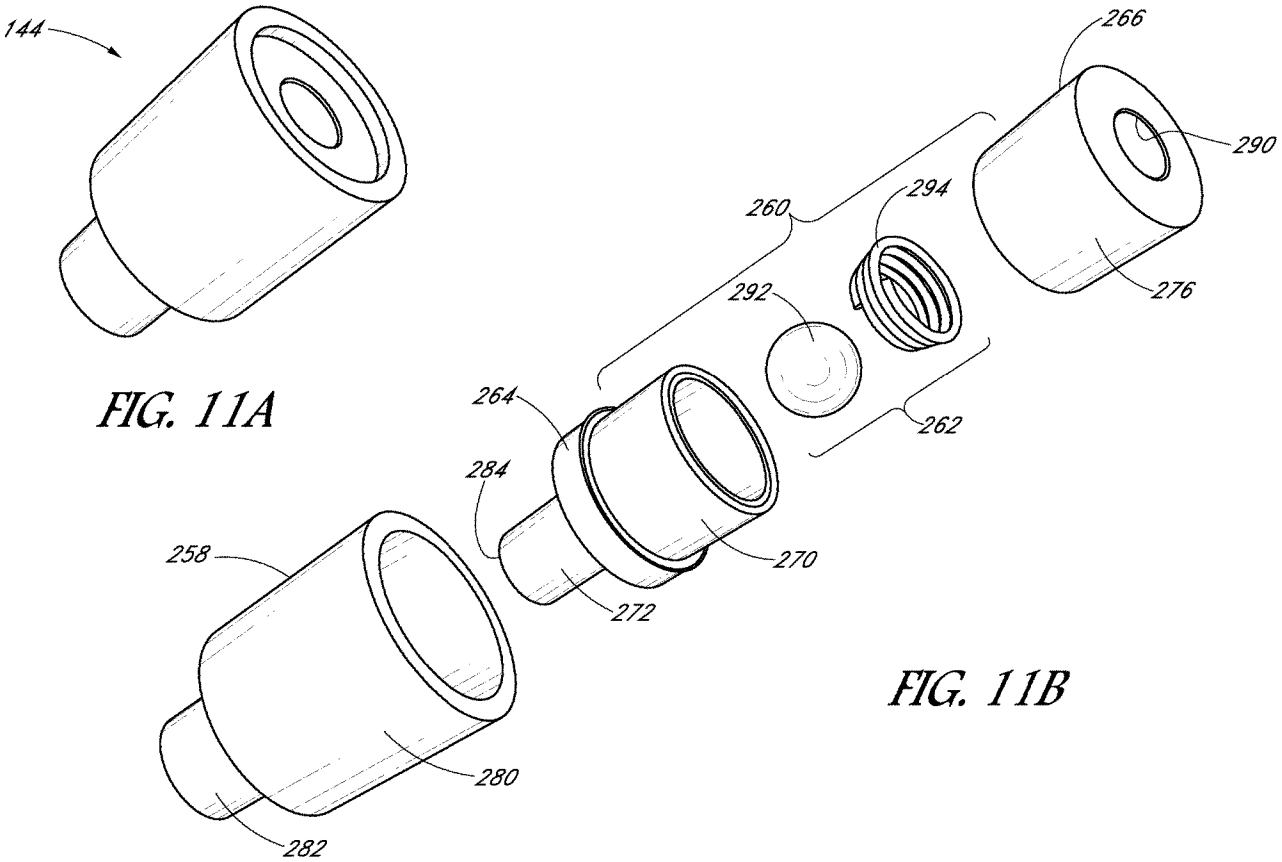
FIG. 11A is a perspective view of a check valve according to one embodiment.
FIG. 11B is an exploded view of the check valve of FIG. 11A.

With continued reference to FIGS. 8-10 and 12, and additional reference to FIGS. 11A and B, one embodiment of the conductive check valve 144 includes a housing 258, a valve body 260, and a sealing structure 262. The valve body 260 is made up of a pin 264 and cap 266, each of which preferably is made of an electronically conductive material such as a metal. In the illustrated embodiment, the conductive pin 262 comprises a hollow proximal cylinder 270 that necks down into a smaller diameter hollow distal cylinder 272. A valve seat 274 is defined where the proximal cylinder 270 necks down into the distal cylinder 272. The conductive cap 266 covers the open end of the proximal cylinder 270 so that the sealing structure 262 is captured between the conductive pin 264 and the conductive cap 266.

In the illustrated embodiment, the conductive cap 266 has an internally threaded side wall 276 extending distally and engaging with external threads formed on the proximal cylinder 270 of the pin 264. In some examples, the conductive cap 266 can be fixed to the proximal cylinder 270 by welding, interference or press fit, snap fit, adhesive, or other attachment means.

The housing 258 also comprises a hollow proximal cylinder 280 that necks down into a smaller-diameter hollow distal cylinder 282. In the illustrated embodiment, the housing 258 is configured to complementarily approximate the shape of the assembled pin 264 and cap 266 that define the valve body 260. As such, the valve body 260 fits snugly within the housing 258. Preferably, the housing 258 is formed of an electrically insulative material such as Delrin.

As shown in FIGS. 8, 9 and 12, the check valve 144 is disposed immediately distal of the atomizer 142 within the atomizer module housing 146. The check valve 144 is placed within the atomizer module housing 146 so that the insulative check valve housing 258 engages the atomizer module housing 146 and electrically insulates the valve body 260 relative to the atomizer module housing 146. A distal end 284 of the conductive pin 264 of the valve body 260 extends distally a short distance from the distal pin 150 of the atomizer module housing 146, and thus is configured to engage the contact 44, which is a first pole of the battery connector, when the atomizer module 140 is connected to the battery assembly 20. The atomizer module housing 146 preferably is electrically conductive so that the pin 150, when engaged with the internal threads 42 of the battery mount cavity 40, engages a second pole of the battery connector.

As discussed above, a first portion 192 of the heating coil wire extends through the first wire hole 186 of the atomizer bowl 160. As best shown in FIG. 12, the first wire portion 192 is sandwiched between the conductive check valve cap and the atomizer. As such, the first wire portion is electrically connected to the conductive check valve 144, which in turn is electrically connected to the first pole of the battery. The second wire portion 194 extends through the second wire hole 188 and into the channel 190. Preferably, the second wire portion 194 extends through and out of the channel 190 so that it is sandwiched between the bowl 160 and the conductive atomizer module housing 146, which is electrically connected to the second pole of the battery. Preferably, the channel 190 has a depth greater than a thickness of the second wire portion 194. As such, the channel 190 enables the second wire portion 194 to be spaced from the conductive portions of the check valve (such as the cap 266 and pin 264), and no electrical connection is made between the second wire portion 194 and the check valve 144.

An electric circuit is defined from the first pole of the battery through the electrically conductive check valve 144 to the first wire portion 192, through the coil 170 to the second wire portion 194, and from the second wire portion through the atomizer module housing 146 to the second pole of the battery. When the circuit is energized, electric current is applied across the heating element coil, which quickly generates heat to vaporize media within the vaporizing chamber.

It is to be understood that, in other embodiments, an insulator can be applied in the channel to electrically insulate the second connection from the valve body. Also, other structure can be employed. For example, the second wire hole may be formed through a side wall of the bowl so that the second wire portion never approaches the conductive valve body.

In the illustrated embodiment, the atomizer module housing 146 is made of a conductive material. In additional embodiments, portions of the atomizer module housing can be made of non-conductive materials, but a conductive layer or portion can be provided that communicates with the second pole of the battery, and which is positioned to be attachable to the second wire portion.

As noted above, the battery connector has a plurality of air intake slots 46 so that air can enter the battery mount cavity 40. As best shown in FIG. 8, the atomizer housing distal pin 150 has air passages 154 that communicate with air passages 286 formed through the insulative check valve housing, and with air passages 288 formed through the check valve pin 264 to enable air to flow from within the battery mount cavity 40 into the hollow valve body 260. The conductive cap 266 of the valve body 260 has a bore 290 extending therethrough. The bore 290 is aligned with the air slots 184 of the atomizer bowl 160 so as to communicate air within the hollow valve body 260 to the vaporizing chamber 180.

Continuing with particular reference to FIGS. 8, 9 and 12, the sealing structure 262 in the illustrated embodiment comprises a ball 292 and a compression spring 294. One end of the compression spring 294 abuts against or is attached to the conductive cap 266, and a second end of the spring 294 urges the ball 292 against the valve seat 274 so as to form a seal. The seal blocks vaporizing media from the vaporizing chamber, wick(s) or tank from leaking into the distal cylinder 272 of the check valve pin 264. This can be especially useful when the personal vaporizer is not in use, as otherwise vaporizing fluid from the tank 210 may slowly flow through the wick(s) and into the vaporizing chamber, through the air slots into the hollow pin, and further through the air passages 288, 286, 154 and out of the personal vaporizer. On warm days, wax within the vaporizing chamber may similarly leak out of the device if left unchecked. When the ball 292 is engaged with the valve seat 274, vaporizing media is blocked from leaking from the device by way of the air passages.

During use, a user drawing a breath generates sufficient suction force or decrease in pressure to dislodge the ball 292 from the valve seat 274. As the user energizes the heating element, and draws a breath, air flow will push the ball 292 out of engagement with the valve seat 274. Also, vaporizing media that may have accumulated in the vaporizing chamber will be vaporized, and fluid that may have accumulated in the valve body 260 proximal of the ball 292 will be drawn into the atomizer bowl 160 and vaporized. When suction force from the user is removed, the spring 294 automatically urges the ball 292 back into engagement with the seat 274.

To use the vaporizing structure 120, the distal tip 150 preferably is connected to the battery mount, and preferably a mouthpiece is attached to the proximal portion 222. The user loads the device with vaporizing media by ensuring the fluid chamber 210 comprises vaporizing liquid and/or detaching the tank module 130 from the atomizer module 140, placing a wax W in the vaporizing chamber 180, and then replacing the tank module 130. The user then presses the battery button 29 and draws a breath through the mouthpiece. The heat element coils 170 quickly heats up, vaporizing wax W within the vaporizing chamber 180 and/or liquid L delivered by the wick 240. Atmospheric air A is drawn through the battery air intake slots 46 and into the hollow pin 264 through the air passages 154, 286, 288. The ball 292 is dislodged from the seat 274 and air A flows around the ball 292 and through bore 290 and air slots 184, past the coils 170 and into the vaporizing chamber 180, where it is mixed with atomized vaporizing media, becoming a vapor V, the vapor V flows proximally through the inlet opening 252 and into the vapor passage 250, from which it is delivered via the mouthpiece to the user.

In some embodiments, a downstream one-way valve can be incorporated inside the vapor tube in order to prevent vaporizing media from leaking out of the vapor tube during periods of nonuse. The downstream one-way valve can be nonconductive and can have any of various valve structures.

As discussed above, the conductive check valve 144 prevents leaks of both liquid and non-liquid vaporizing media. Thus, it should be understood that a conductive check valve can be employed in embodiments of personal vaporizers configured for use solely with only one of liquid and non-liquid vaporizing media as well as embodiments configured for use with both liquid and non-liquid vaporizing media.

Although the illustrated embodiment employs a ball-and-spring type valve, it is to be understood that other embodiments can employ check valves having any of various types of check valve structure. Preferably, however, the check valve will employ a housing or other conductive pathway through which electrical energy may pass as it is supplied to the atomizer. Although the illustrated embodiment discloses a particular circuit that extends through the valve body and through the conductive cover, which is insulated relative to the valve body, it is to be understood that other embodiments can employ different specific circuit pathways, which pathways preferably employ structure of the device to supply electric current.

Figure 13:
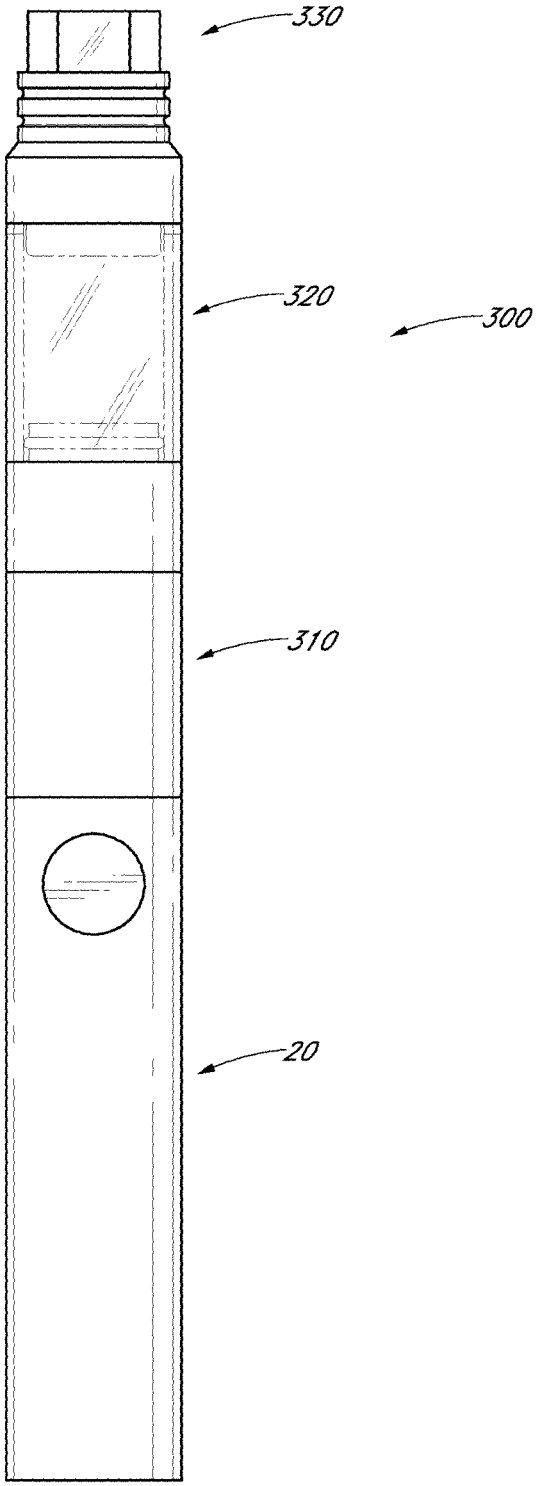
FIG. 13 is a side view of another embodiment of a personal vaporizer.

With reference next to FIG. 13, another embodiment of a hybrid personal vaporizer 300 is shown. The illustrated hybrid personal vaporizer 300 comprises an atomizer module 310 that is releasably attachable to a battery assembly 20. A tank module 320 is releasably connectable to the atomizer module 310, and a mouthpiece module 330 is releasably attachable to the tank module 320. As will be discussed below, the structure of the illustrated hybrid personal vaporizer 300 is somewhat different than the structure of embodiments described above. To be sure, the illustrated hybrid personal vaporizer employs some features not discussed in previous embodiments. However, certain of the structures operate on principles similar to features described in conjunction with the above embodiments.

With additional reference to FIGS. 14-17, the atomizer, tank and mouthpiece modules of the embodiment of FIG. 13 are shown in more detail and in cross-section. As shown, the atomizer module comprises an atomizer 332 and a check valve enclosed within an atomizer module housing 336. The atomizer module housing 336 comprises a proximal end 338 that preferably is threaded so as to be selectively attachable to the tank module 320. An internal transverse wall 340 is disposed between the proximal end 338 and a distal end 342 of the atomizer module housing 336. Air slots 344 are formed at the distal end 342. A distal cavity 346 is defined within the atomizer module housing 336 between the distal end and the transverse wall 340. A proximal cavity 348 is defined between the proximal end and the transverse wall 340. As shown, the conductive check valve 334 is supported by the transverse wall 340. The atomizer 332 is disposed in the proximal cavity 348.

Figure 16:
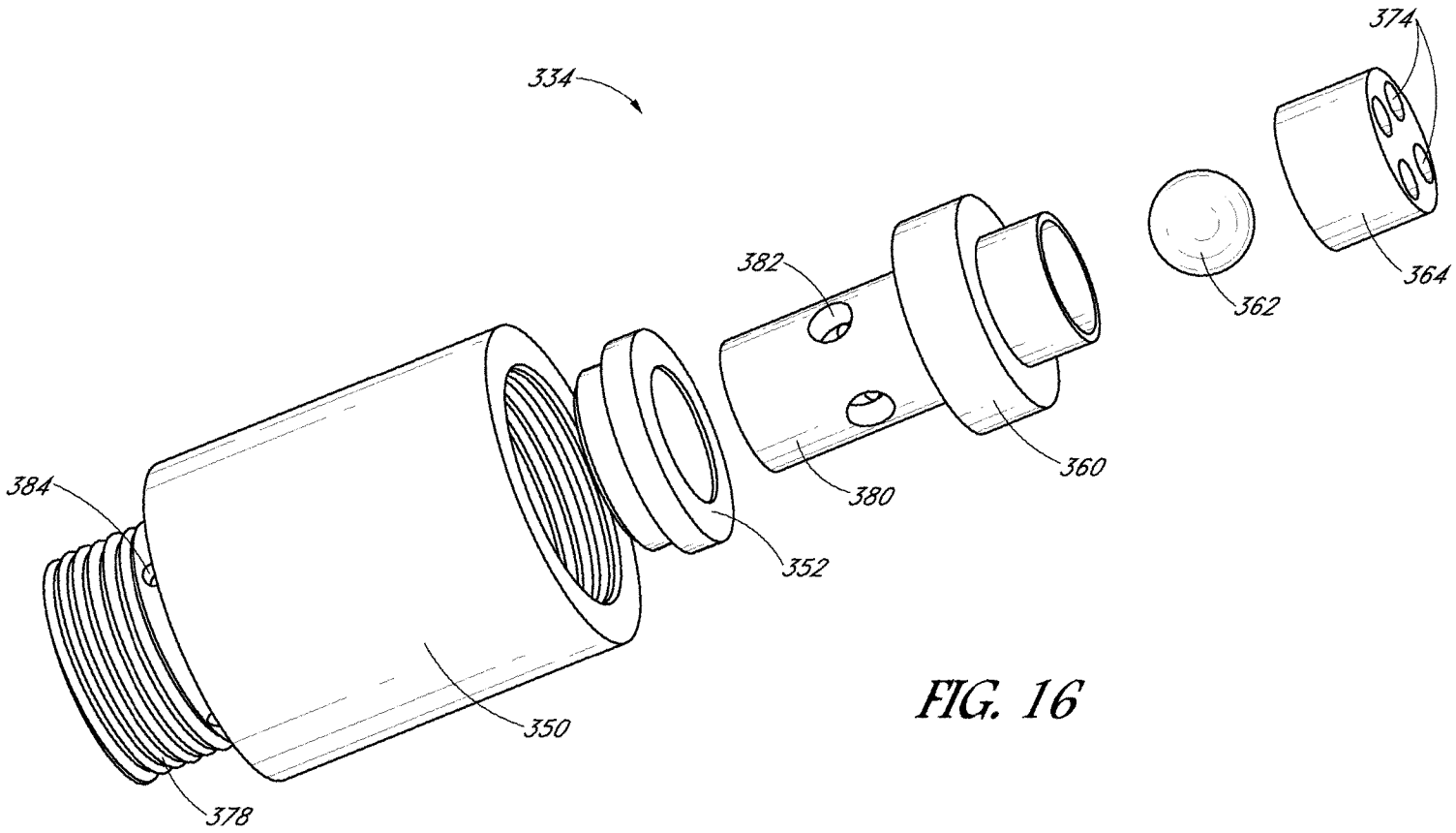
FIG. 16 is an exploded view of another embodiment of a check valve.
Figure 17:
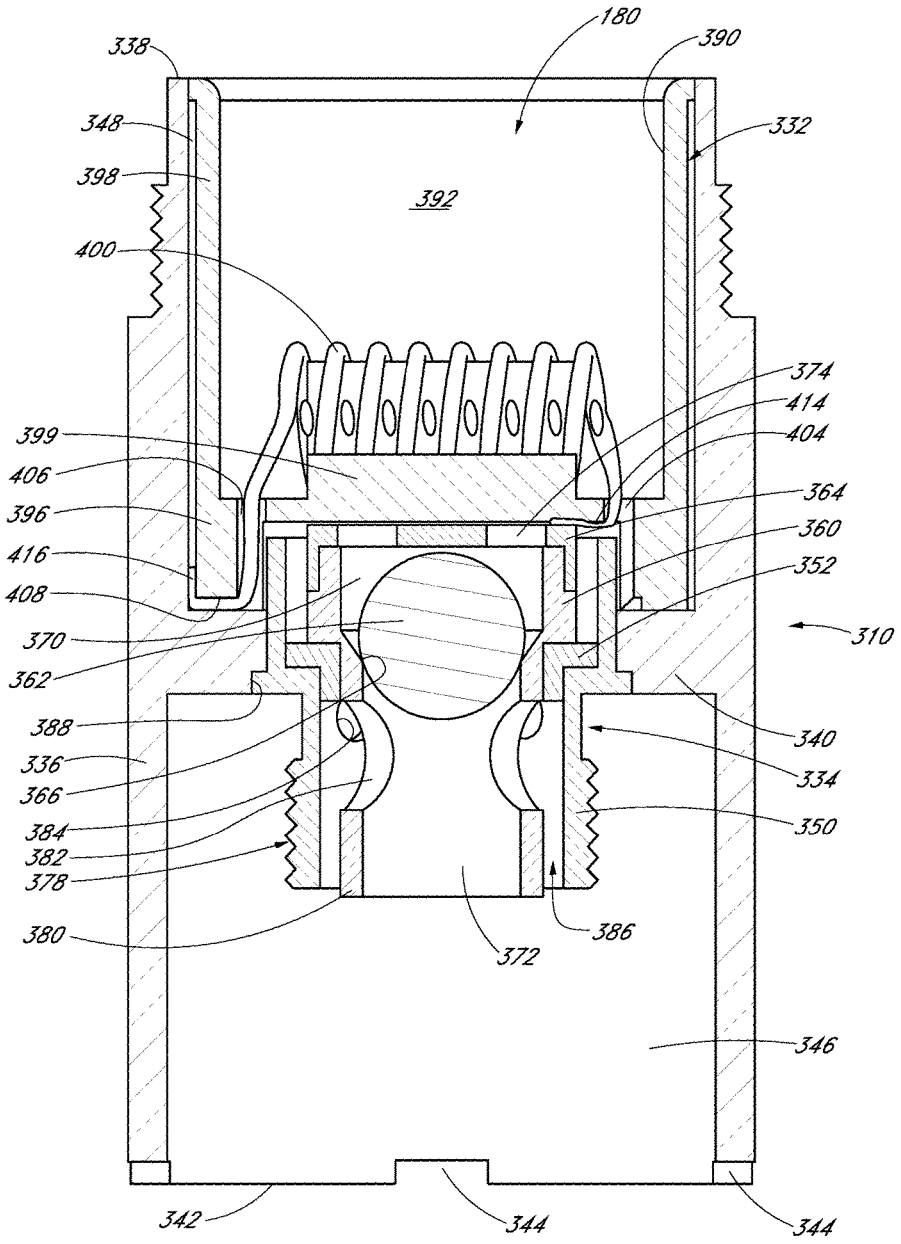
FIG. 17 is a close up view of an atomizer module portion of the structure depicted in FIG. 15.

With particular reference to FIGS. 16 and 17, in the illustrated embodiment, the check valve 334 comprises a housing 352, an insulator 352, a pin 360, a ball 362 and a cap 364. As shown, the insulator 352 fits between the housing 352 and the pin 360 in order to electrically insulate the housing 352 from the pin 360 and to space the housing from the pin 360. Preferably, both the housing and the pin 360 are electrically conductive. The pin 360 preferably is hollow and has a seat 366 defined between a proximal and a distal cavity 370, 372.

The cap 364 attaches to the proximal end of the pin 360 so as to enclose the proximal cavity. Like the pin 360, the cap 364 preferably is electrically conductive. The cap 364 comprises a plurality of cap apertures 374 that are radially spaced from a center point that is aligned with an axis of the pin 360. As such, the cap 364 preferably is solid at its center point. The ball 362 is contained within the proximal cavity and is constrained to move between engagement with the seat 366 and contact with the center point of the cap 364. When the ball 362 is engaged with the seat 366, fluid flow is blocked from moving between the proximal and distal cavities of the pin 360. However when the ball 362 is disengaged from the seat 366, and possibly engaged with the center point of the cap 364, flow of air through the plurality of cap apertures 374 and proximally from the pin distal cavity to the proximal cavity is unimpeded by the ball 362.

The housing preferably includes a distal threaded tip 378 that is sized and configured to threadingly engage the internal threads 42 of the battery mount cavity 40 so that the housing can be electrically connected to the second pole of the battery. A distal tip 380 of the pin 360 extends a short distance distally of the housing distal tip and is configured to engage the battery contact 44 when the housing distal tip is engaged with the battery mount cavity 40. As such, the pin distal tip engages the first pole of the battery.

The pin 360 has a plurality of side apertures 382 distal of the seat 366. Similarly, the check valve housing 350 has a plurality of side apertures 384. Each of these apertures open into a space 386 between the pin 360 and the housing so that air may flow freely from within the distal cavity of the atomizer module 310 into the pin cavities.

When the atomizer module 310 is mounted to the battery, atmospheric air can flow through the air slots 344 into the distal cavity, and further from the distal cavity through the apertures and into the distal cavity of the pin 360. When the ball 362 is disengaged from the seat 366, air from within the distal cavity can flow proximally past the ball 362 and further through the cap apertures 374. When the ball 362 is engaged with the seat 366, leakage a vaporizing media is blocked as in embodiments discussed above.

In the illustrated embodiment, there is no biasing member to urge the ball 362 against the seat 366. Nevertheless, the ball 362 is configured to be urged into engagement with the seat 366 by forces such as gravity, when the personal vaporizer is upright, and/or by flow of vaporizing media in a distal direction through the proximal cavity of the pin 360. Thus, flow of vaporizing media in a direction tending to leak from the device will urge the ball 362 into sealing engagement with the seat 366. Of course, it is to be understood that, in additional embodiments, any type of biasing member, and any type of check valve structure, can be employed as desired.

Figure 15:
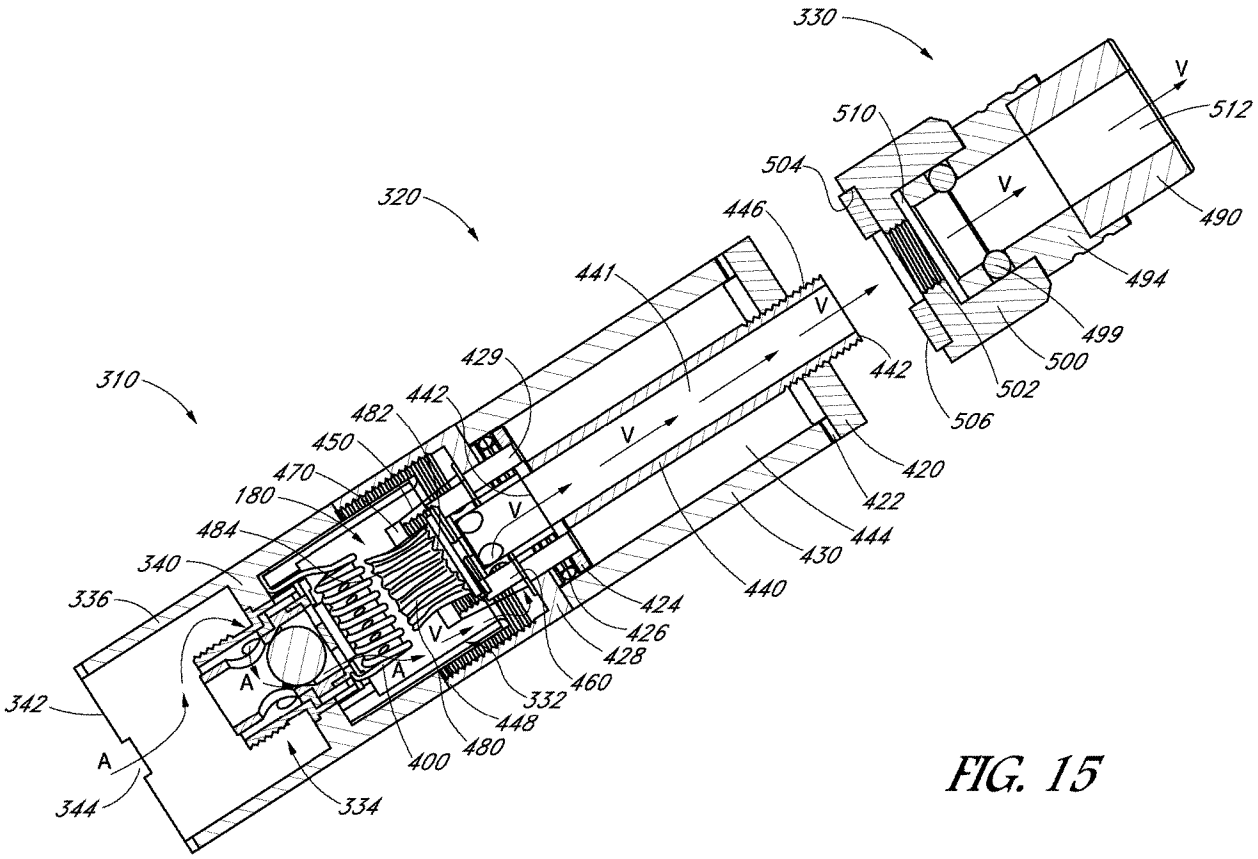
FIG. 15 is a cross-sectional view taken along lines 15-15 of FIG. 14, except that the tank and atomizer modules are shown connected to one another.

Continuing with reference to FIGS. 15-17, in the illustrated embodiment, a mount aperture 388 is formed through the transverse wall 340 of the atomizer module housing 336, and the check valve housing 350 is press-fit into the mount aperture 388 so that the check valve 334 is held in place within the atomizer module 310 with a proximal portion of the check valve 334 extending into the proximal cavity and a distal portion of the check valve 334 extending into the distal cavity.

Figure 19:
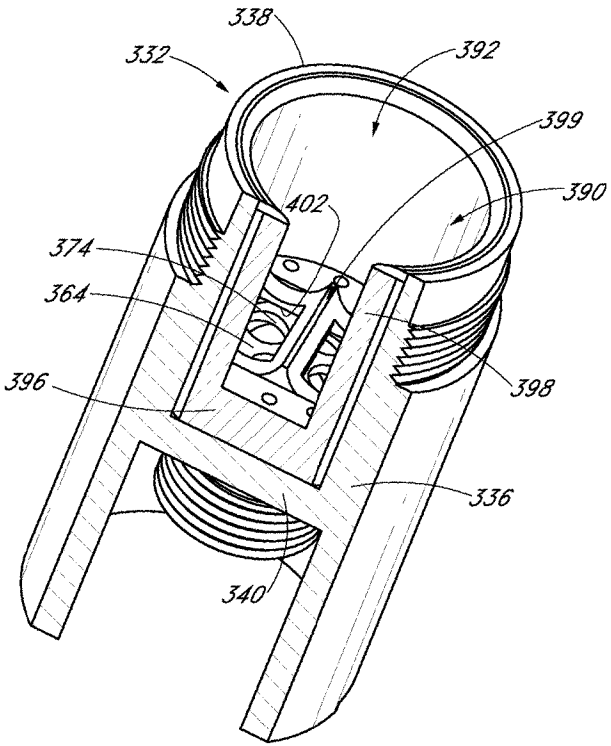
FIG. 19 is a partially cutaway perspective view of the atomizer of FIG. 14.
Figure 18:
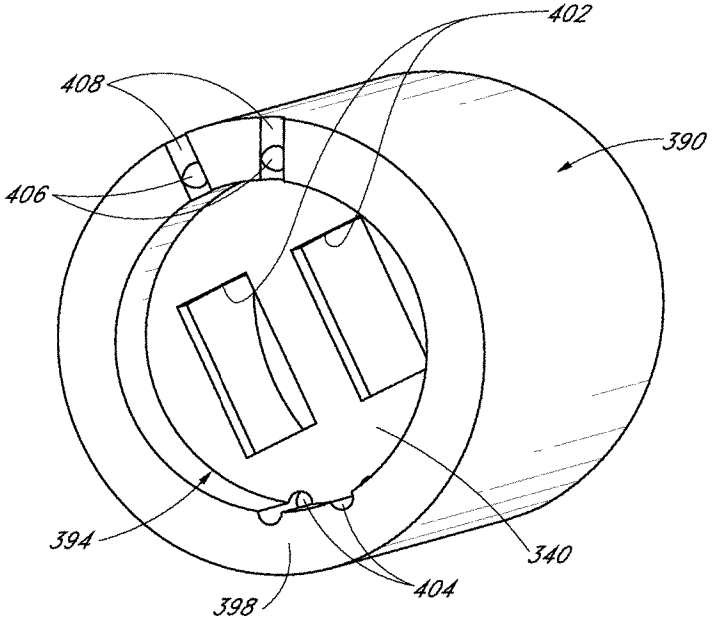
FIG. 18 is a perspective view of another embodiment of an atomizer cup.

With additional reference to FIGS. 18 and 19, in the illustrated embodiment the atomizer 332 comprises an atomizer bowl 390 having a proximal cavity 392 and a distal cavity 394. A bottom wall 396 is defined between the proximal and distal cavities, and a side wall 398 of the bowl 390, in combination with the bottom wall 396, defines the proximal and distal cavities.

As best shown in FIG. 19, preferably a pair of arcuate cradles 399 are formed on the proximal side of the bottom wall 396. The arcuate cradles 399 generally complementarily correspond to the curvature of heating element coils 400 that are arranged adjacent the cradles. An air slot 402 is formed in each cradle so as to be aligned with the corresponding coil. A pair of first wire holes 404 is formed through the bottom wall 396 and open into the distal cavity. A pair of second wire holes 406 are also formed through the bottom wall 396 but do not open into the distal cavity. Instead, the second wire holes extend through a portion of the side wall and open at a distal end of the side wall. Channels 408 are formed in the side wall so as to extend from each second wire hole to a side surface of the bowl 390.

With particular reference to FIGS. 17 and 19, the bowl 390 preferably is fit into the proximal cavity of the atomizer module housing 336 so that distal ends of the side walls engage the transverse wall 340, and the proximal portion of the check valve 334 extends into the distal cavity of the bowl 390. Preferably, at least portions of a plurality of the cap apertures 374 are aligned with each air slot.

Continuing with particular reference to FIG. 17, for each of the coils, a first wire end portion 414 of the coil extends through one of the first wire holes 404 and is placed into contact with the conductive check valve cap 364 without contacting the conductive check valve housing 350. A second wire end portion 416 of the coil extends through one of the second wire holes 406 and into contact with the conductive atomizer module housing 336, which is physically and electrically connected to the conductive check valve housing 350. As such, the first wire end portion is connected through the check valve cap 364 and pin 360 to the first pole of the battery, and the second wire end portion is connected through the atomizer module housing 336 and check valve housing 350 to the second pole of the battery, defining a circuit enabling the battery to energize the coils when actuated.

Figure 20:
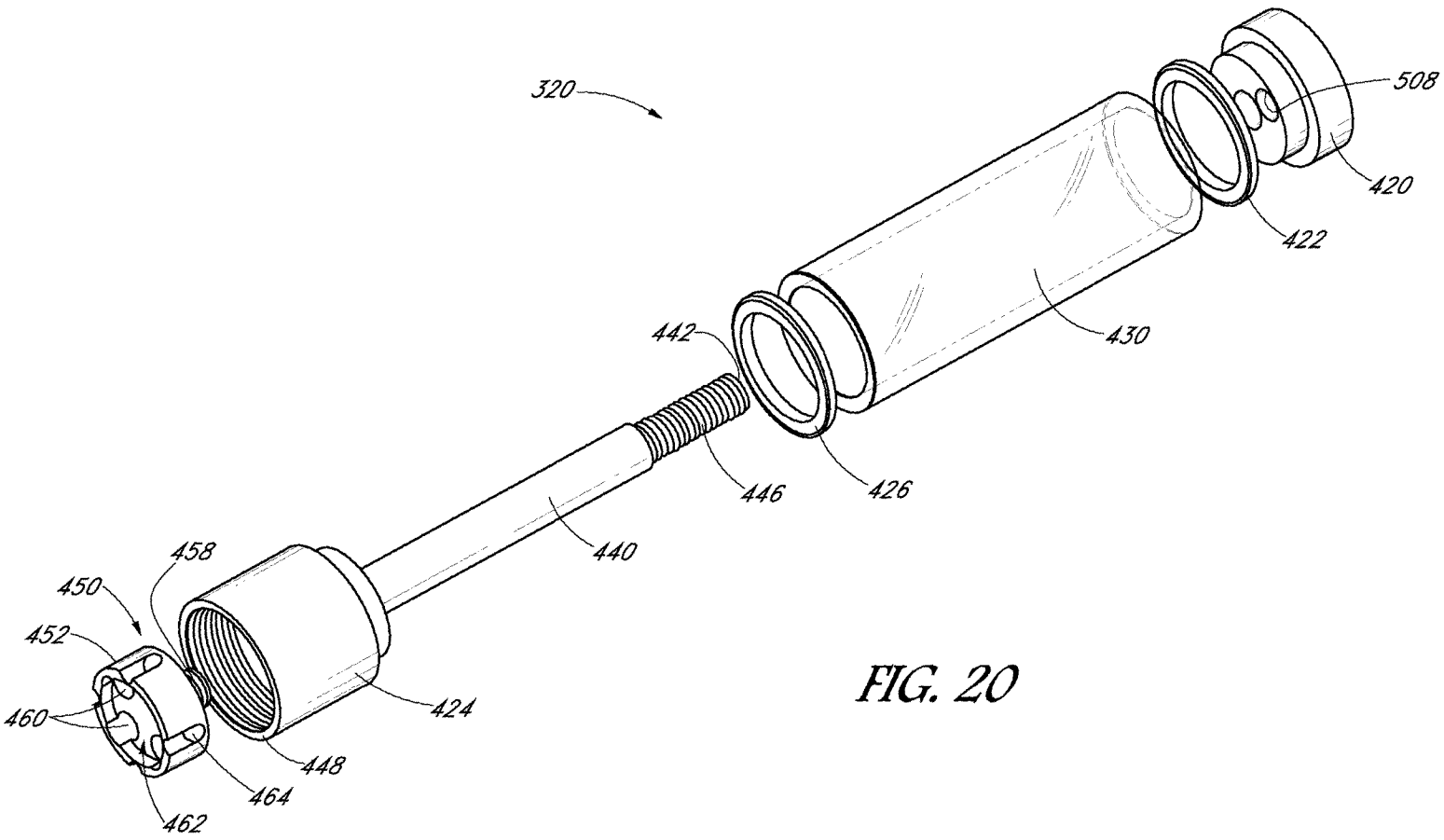
FIG. 20 is an exploded view of the tank module of FIG. 14.

With continued reference to FIG. 15 and additional reference to FIG. 20, the tank module 320 comprises a tank top wall 420 that supports a proximal seal for 22. A tank base 424 is configured to support an O-ring for 26, and defines a bottom wall 428. A tubular outer wall 430 is disposed between the top and bottom wall 428. A vapor tube 440 extends proximally from the base and defines a vapor passage 441 therewithin. A proximal end 442 of the vapor tube 440 threadingly engages the tank top wall 420 so that the tank top wall 420 can be advanced toward the base. When the top wall 420 is threadingly advanced over the proximal end of the vapor tube 440, the outer wall 430 is sandwiched between the top and bottom walls so as to create seals with the proximal seal and O-ring and define a fluid chamber 444, or tank, therewithin. A proximal portion 446 of the vapor tube 440 extends proximally from the tank top wall 420. A central aperture is formed in the bottom wall 428 and communicates with the vapor passage 441. A distal end 148 of the base is threaded so as to threadingly connect to the atomizer module housing 336.

Figure 21A:
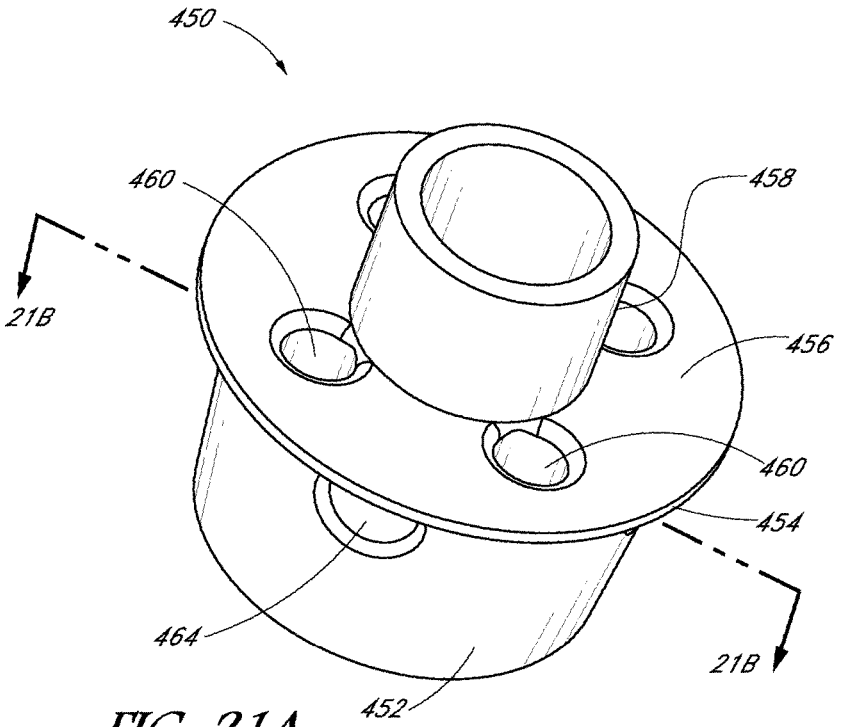
FIG. 21A is a perspective view of a transfer member of the tank module of FIG. 14.
Figure 21B:
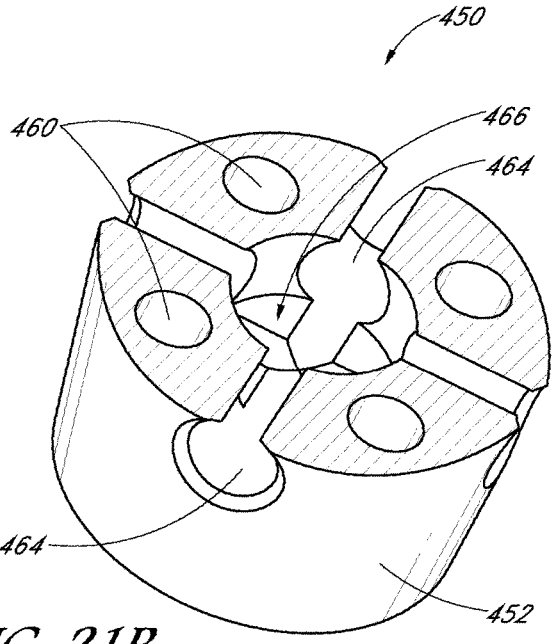
FIG. 21B is a cross-sectional view taken along line 21B-21B of FIG. 21A.

With continued reference to FIGS. 15 and 20, and additional reference to FIGS. 21A and 21B, a transfer member 450 comprises a cylindrical body 452 having a proximal flange 454. A proximal face 456 is defined on a proximal side of the proximal flange. A proximal connector 458 extends proximally from the proximal face and is configured to engage the central aperture of the base. In one embodiment, the proximal connector is threaded so that the proximal face can be advanced and fit snugly against the distal face of the tank module bottom wall 428.

A plurality of elongate secondary fluid delivery holes 460 extend longitudinally through the proximal face and the body. Preferably, the transfer member 450 is attached to the base so that the secondary fluid delivery holes 460 are at least generally aligned with the fluid delivery holes formed through the bottom wall 428. Also, preferably the proximal face generally sealingly engages the distal face of the tank module bottom wall 428 so that fluid from the tank will flow through the fluid delivery holes and secondary fluid delivery holes, and not between the proximal face and distal face of the tank module bottom wall 428. In another embodiment, the transfer member 450 can be press-fit against the bottom surface of the tank bottom wall 428. Other methods can also be used to attach the proximal face of the transfer member 450 tightly to the bottom surface of the tank bottom wall 428.

A distal cavity 462 is formed in the transfer member body 452, and the secondary fluid delivery holes 460 extend through the body and open into the distal cavity 462.

A plurality of transversely-directed vapor inlets 464 are also formed in the transfer member body. The vapor inlets 464 are placed so as to not intersect or interfere with the secondary fluid delivery holes 460. The vapor inlets communicate with a central vapor chamber 466 formed within the body, which central vapor chamber 466 is aligned with the proximal connector so that the central vapor chamber 466 is in communication with the vapor passage 441.

With particular reference again to FIG. 15, vaporizing fluid from within the fluid chamber 444 can be delivered to the vaporizing chamber 180 by flowing through the fluid delivery holes 429 of the bottom wall 428 and further through the secondary fluid delivery holes of the transfer member 450 into the vaporizing chamber 180. After being atomized, the vapor flows from the vaporizing chamber into the vapor inlets of the transfer member 450 to the central vapor chamber 466 and further to the vapor passage 441, from which it is delivered to the mouthpiece module 330.

Figure 22A:
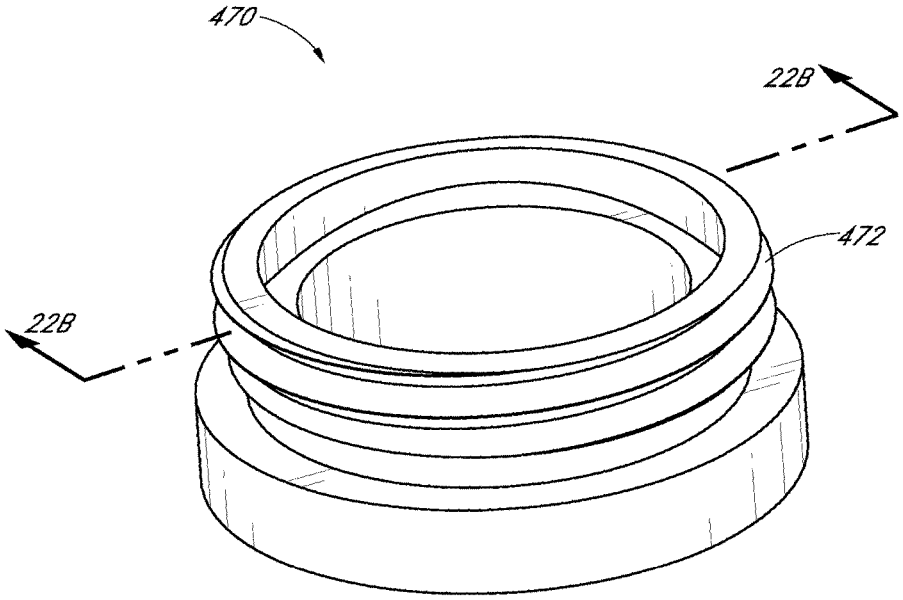
FIG. 22A is a perspective view of an embodiment of a wick holder.
Figure 22B:
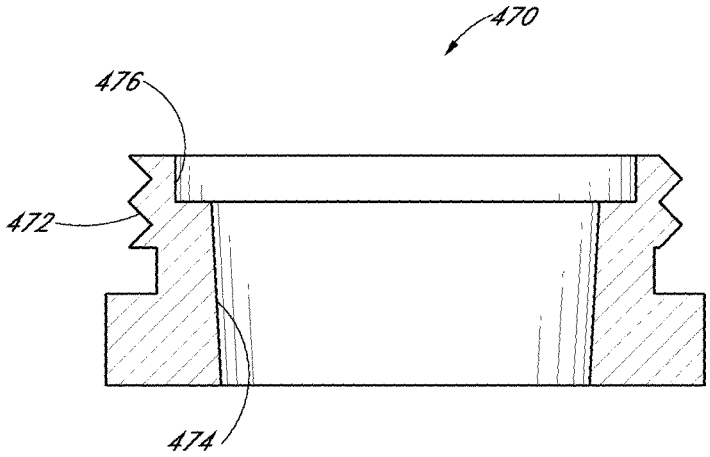
FIG. 22B is a cross-sectional view taken along line 22B-22B of FIG. 22A.

With continued reference to FIG. 15 and additional reference to FIGS. 22A and 22B, a wick holder 470 is configured to fit into and attach to the distal cavity of the transfer member 450. Preferably, the wick holder 470 includes proximal threads 472 adapted to engage internal threads of the transfer member 450 so that the wick holder 470 can be attached to the transfer member 450. The wick holder 470 defines a wick holding passage 474 which, in the illustrated embodiment, is generally tapered to decrease in diameter moving distally. As such, the wick holding passage 474 can securely hold a wick therewithin. A proximal space 476 having a diameter greater than the wick holding passage is defined proximal of the wick holding passage. As shown in FIG. 15, a wick 480 can be retained by the wick holding passage 474. Preferably, a proximal end 482 of the wick 480 is disposed in or distal of the proximal space 476, and the distal end 484 of the wick 480 is disposed at or adjacent the heating element of the atomizer 332.

In the illustrated embodiment, the wick 480 has a generally circular cross-section, is generally longitudinally aligned with the heating element, and has a diameter greater than one half the length of each heating element coil, more preferably greater than two thirds the length of each heating element coil, and in some embodiments greater than about three fourths the length of each heating element coil. In further embodiments the wick diameter is about the same as or greater than the length of each heating element coil.

In the illustrated embodiment, the wick 480 is completely distal of the bottom wall 428 of the tank so that no wick portion extends into the fluid chamber 444. As such, fluid flowing through the delivery holes is unconstrained by any wick or any other throttling structure. Similarly, fluid flow through the secondary fluid delivery holes is unconstrained by the presence of any wick. Instead, fluid flows freely through the fluid delivery holes and secondary fluid delivery holes, and accumulates in the proximal space above the wick. The proximal space enables fluid to spread out and evenly soak the wick. In the illustrated embodiment, the proximal space and wick are disposed within the proximal cavity of the atomizer module housing 336.

In the illustrated embodiment, a cross sectional area of the wick is about the same as or greater than a cross-sectional area of the vapor passage 441. Similarly, the cross-sectional area of the wick preferably is greater than the combined cross-sectional area of all of the fluid delivery holes. Further, preferably the cross-sectional area of the vapor passage is greater than the combined cross-sectional area of the fluid delivery holes. As such, the diameter of the vapor tube 440, and cross-sectional area of the vapor passage 441, can be maximized while the cross-sectional area dedicated to delivery tubes 429 is minimized, but without negatively affecting delivery flow of fluid through the wick 480 to the heating element 400. For example, in some embodiments, a ratio of the vapor passage diameter to an outer diameter of the tank module 320 is greater than 0.2. In further embodiments, the ratio is between 0.2 and 0.3, and in further embodiments the ratio is about 0.25.

In the illustrated embodiment, a single, relatively large, centrally-located wick is held by the wick holder 470. It is to be understood that other embodiments may employ a plurality of wick holding passages, and thus may hold a plurality of wicks. The plurality of wicks may each be smaller in diameter than the wick illustrated in FIG. 15, although the wicks collectively may present a cross-sectional area approaching, the same as, or even greater than the wick in the illustrated embodiment, or greater than the cross-sectional area of the vapor passage. Additionally, such embodiments can be configured so that wicks are more evenly distributed about the vaporizing chamber 180, and at or adjacent most or all portions of the heating element coils.

In the illustrated embodiment, the wick holder 470 can be removed from the transfer member 450 and replaced with another wick holder. The replacement wick holder may have a different configuration, may use different wick materials, or may simply be a new wick that hasn't been fouled by extensive use. Also, it is anticipated that different vaporizing liquids will have different viscosities. Thus, a user may wish to select a wick calculated to maximize device performance for a particular range of liquid viscosities. Notably, in the illustrated embodiment, the wick holder attaches to structure of the tank module 320, and comes with the tank module as the tank module 320 is detached from the atomizer module. As such, the wick holder is easily accessed by simply removing the tank module, and without disassembling the tank.

The illustrated transfer member 450 and wick holder 470 are generally cylindrical in shape, and the illustrated wick holder 470 attaches to the transfer member 450 via a threaded connection. It is to be understood that, in additional embodiments, various ways of connecting the wick holder to the transfer member can be employed, such as a j-lock, detent, or slide-in mechanism. Also, the transfer member and/or wick holder and/or wick may have a non-circular cross-section. For example, in some embodiments the wick holder and wick may have a rectangular cross-sectional shape, and may be sized to correspond to the cross-sectional footprint of the heat element coils. As such, the wick may deliver vaporizing fluid to every part of the coils.

Figure 14:
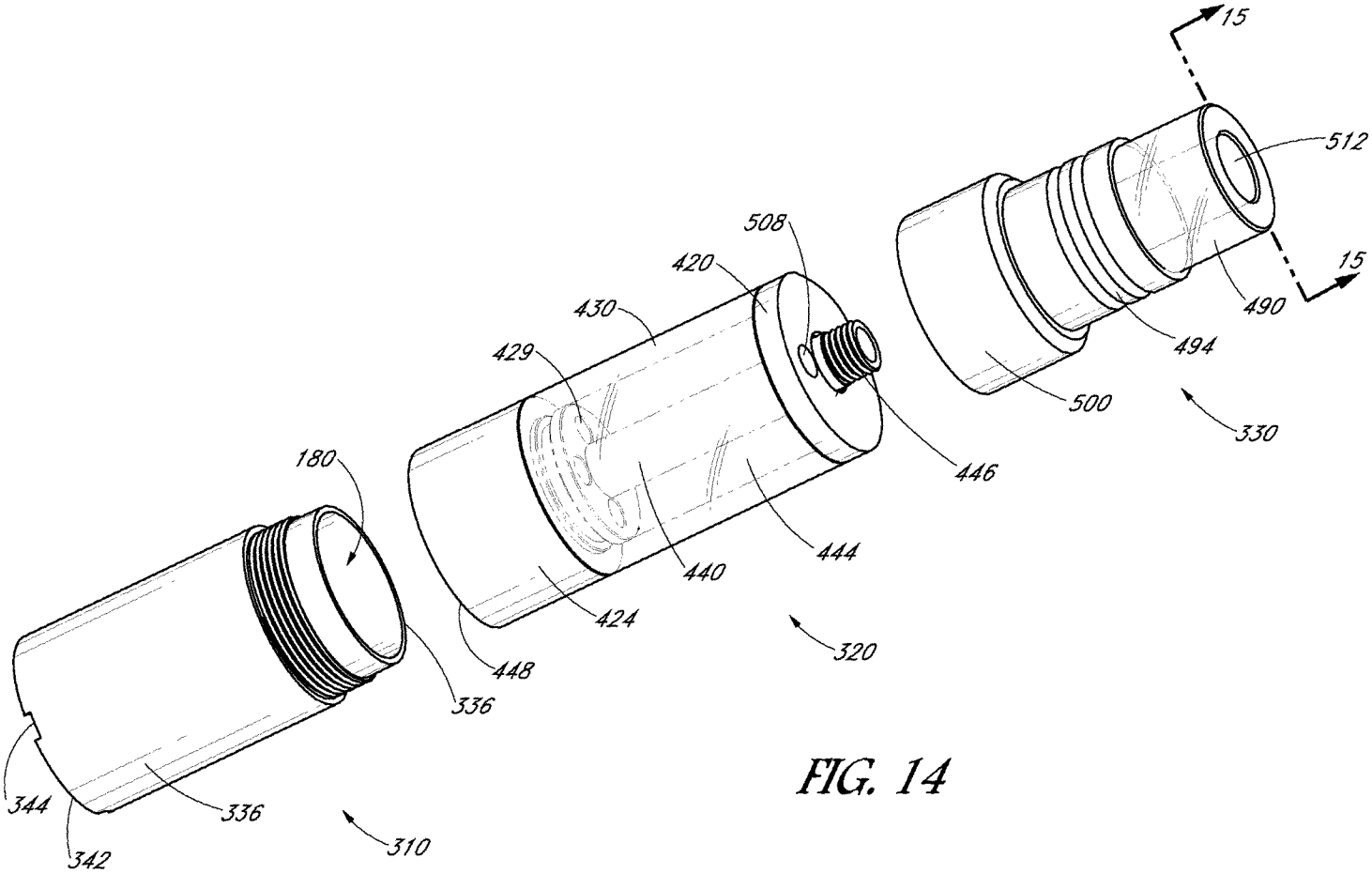
FIG. 14 is an exploded view of mouthpiece, tank and atomizer modules of the personal vaporizer of FIG. 13.
Figure 23:
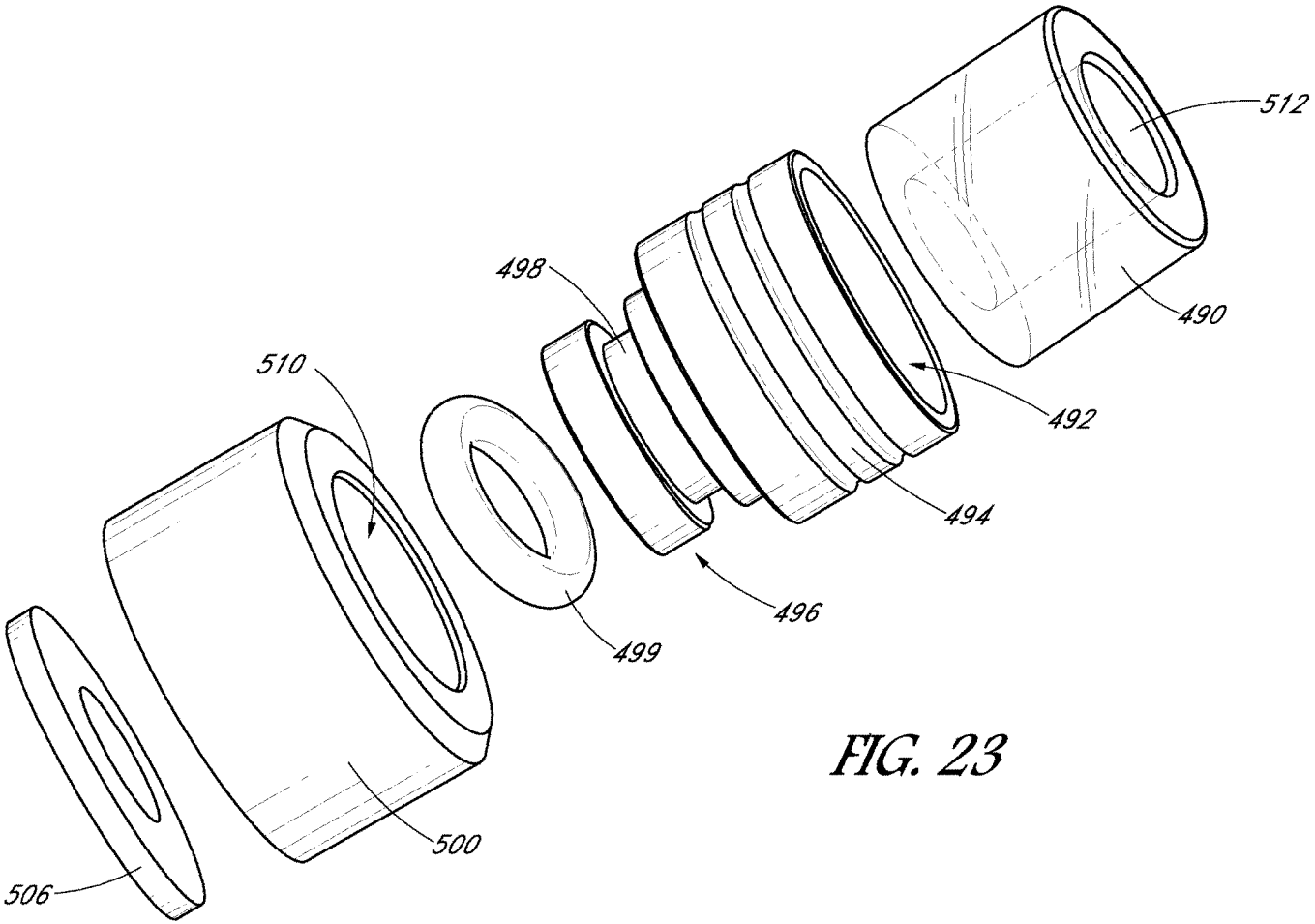
FIG. 23 is an exploded view of the mouthpiece embodiment of FIG. 14.

Continuing with reference to FIGS. 14 and 15, and with additional reference to FIG. 23, the mouthpiece module 330 comprises a tubular mouthpiece 490, which in some embodiments can be substantially transparent, that is received into a proximal cavity into of a mouthpiece base 494. A distal portion 496 of the mouthpiece base comprises an O-ring seat 498 that receives an O-ring 499. A mouthpiece mount 500 has a central threaded passage 502 that engages the proximal portion of the vapor tube 440 so that the mouthpiece module 330 can be tightened atop the tank module 320.

A distal cavity 504 of the mouthpiece mount receives an elastomeric seal 506 that engages the top wall 420 of the tank module 320 so as to seal a tank fill opening 508 and help provide a tight fit between the mouthpiece module 330 and the tank module 320. The central threaded passage 502 opens into a proximal cavity 510 of the mount 500, into which the distal portion of the mouthpiece base is placed. The O-ring on the mouthpiece base engages a wall of the mount proximal cavity to create a seal so that vapor that flows through the vapor passage 441 and central threaded passage is further directed through a mouthpiece outlet 512.

To use the personal vaporizer described in connection with FIGS. 13-23, The user loads the device with vaporizing media by ensuring the fluid chamber 444 comprises vaporizing liquid L and/or detaching the tank module 320 from the atomizer module 310 and placing a wax W in the vaporizing chamber 180, and then replacing the tank module. The user then presses the battery button 29 and draws a breath through the mouthpiece. The heat element coils quickly heat up, vaporizing wax W within the vaporizing chamber 180 and/or liquid L delivered by the wick. Atmospheric air A is drawn through the battery air intake slots 46 and into distal cavity, from which it flows through side holes and into the distal cavity of the pin 360. The ball 362 is dislodged from the seat 366, and air A flows around the ball 362 and through any of the plurality of cap apertures 374 and air slots, past the coils and into the vaporizing chamber, where it is mixed with atomized vaporizing media, becoming a vapor V, the vapor V flows proximally through the vapor inlets of the transfer member 450 and into the vapor passage 441, from which it is delivered via the mouthpiece to the user. As vaporizing liquid L is being atomized, replacement liquid L flows from the fluid chamber 444 through the fluid delivery tubes and secondary fluid delivery tubes into the proximal space proximal of the wick. The liquid L spreads across the diameter of the wick, and is then communicated through the wick to the coils 400, where it is atomized and mixed with air A to form the vapor V.

It is to be understood that the embodiments of a modular, hybrid personal vaporizer disclosed herein can be used with wax alone, liquid solution alone, or both wax and solution at the same time. Further, if being used with both wax and solution at the same time, and one or the other of the wax or solution becomes exhausted, the hybrid personal vaporizer can continue to be used with the remaining material without necessitating any adjustments by the user. Further, it is to be understood that features disclosed herein may be employed with other embodiments of vaporizers, which embodiments may or may not be able to used with one or the other of wax and liquid solutions. Further, features discussed herein may be employed with vaporizers that are not modular.

In the illustrated embodiments, the fluid tank has been configured as a single compartment to hold a single liquid. In additional embodiments the tank can be divided into two, three or more chambers and can be configured to hold different liquid media, such as different flavors of liquid and/or different ingredients. In some embodiments such chambers can be configured to contain separate components. For example, a first chamber may contain a basic vaporizing fluid, and a second and/or third chamber may be configured to contain flavorings. Each chamber communicates with the vaporizing chamber 180 via liquid delivery holes and/or wicks, and thus liquid from each chamber is delivered simultaneously to the vaporizing chamber. The size of the delivery tubes and/or wicks can throttle delivery rates from each chamber, regulating the mixture. For example, the delivery tube(s) and/or wick from the first chamber may be configured to delivery much more volume of fluid to the vaporizing chamber than the delivery tube and/or wick from the second or third chambers. This can be accomplished in various ways, such as by providing delivery tubes of greater cross-sectional area aligned with the first chamber and comparatively small cross-sectional area aligned with the second and/or third chambers, using different wick materials that regulate fluid flow, or the like.

The embodiments discussed above have disclosed structures with substantial specificity. This has provided a good context for disclosing and discussing inventive subject matter. However, it is to be understood that other embodiments may employ different specific structural shapes and interactions. For example, the vaporizer embodiments discussed herein are generally cylindrical. It is to be understood that other embodiments may employ principles discussed herein in connection with vaporizers having different shapes and configurations.

Although inventive subject matter has been disclosed in the context of certain preferred or illustrated embodiments and examples, it will be understood by those skilled in the art that the inventive subject matter extends beyond the specifically disclosed embodiments to other alternative embodiments and/or uses of the invention and obvious modifications and equivalents thereof In addition, while a number of variations of the disclosed embodiments have been shown and described in detail, other modifications, which are within the scope of the inventive subject matter, will be readily apparent to those of skill in the art based upon this disclosure. It is also contemplated that various combinations or subcombinations of the specific features and aspects of the disclosed embodiments may be made and still fall within the scope of the inventive subject matter. Accordingly, it should be understood that various features and aspects of the disclosed embodiments can be combined with or substituted for one another in order to form varying modes of the disclosed inventive subject matter. Thus, it is intended that the scope of the inventive subject matter herein disclosed should not be limited by the particular disclosed embodiments described above, but should be determined only by a fair reading of the claims that follow.

What is claimed is:

1. A personal vaporizer, comprising:

an atomizer module having a proximal end and a distal end, and comprising a bowl and a coil arranged in or adjacent the bowl, the bowl configured to accept a wax having an essential oil, the bowl having an open proximal end, the open proximal end disposed at the proximal end of the atomizer module;

a battery assembly, the atomizer module connectable to the battery assembly so that actuation of the battery assembly delivers electrical energy to the coil, causing the coil to heat and vaporize a wax that may be in the bowl; and a tank module selectively attachable to the proximal end of the atomizer module so that the atomizer module is disposed between the tank module and the battery assembly, the tank module comprising a fluid tank configured to contain a vaporizing liquid therewithin, a distal wall of the fluid tank comprising a fluid delivery hole, an elongated wick extending through and supported by the fluid delivery hole so that a proximal end of the wick is within the fluid tank and a distal end of the wick extends distally from the fluid tank, the wick configured to communicate vaporizing liquid from the fluid tank to the distal end of the wick;

wherein when the tank module is attached to the atomizer module the distal end of the wick extends into the bowl;

wherein when the tank module is removed from the atomizer module, the distal end of the wick is removed from the bowl, and the open proximal end of the bowl is accessible so as to place a wax into the bowl; and wherein a wax placed in the atomizer module bowl and a vaporizing liquid supplied from the fluid tank to the atomizer module bowl can be simultaneously vaporized within the bowl by the coil so as to form a combined vapor by simultaneously vaporizing both the wax and the vaporizing liquid.

2. A personal vaporizer as in claim 1, comprising:

a check valve comprising an insulator housing, a conductive shell inside the insulator housing, and a sealing mechanism inside the conductive shell, the conductive shell having an air inlet and an air outlet, an intake air flow path defined through the conductive shell from the air inlet to the air outlet, the sealing mechanism providing a seal inside the conductive shell, the seal interposed in the intake air flow path, the check valve arranged so that the air outlet communicates with an air aperture formed in the bowl and the conductive shell is electrically connected to the coil so that electrical energy from the battery assembly passes through the conductive shell before being delivered to the coil.

3. A personal vaporizer as in claim 2, wherein the bowl has a first wire hole and a second wire hole extending through a bottom wall of the bowl and a channel extending transversely from the second wire hole and through a side wall of the bowl.

4. A personal vaporizer as in claim 3, wherein the coil is a heating element having a first connection and a second connection, the first connection extending through the first wire hole and contacting the conductive shell, and the second connection extending through the second wire hole and the channel and spaced away from the conductive shell.

5. A personal vaporizer as in claim 2, wherein the sealing mechanism comprises a ball and a spring.

6. A personal vaporizer as in claim 1, additionally comprising one or more slots formed through a side wall of the bowl.

7. A personal vaporizer as in claim 1, wherein when the tank module is removed from the atomizer module, the coil in the bowl is directly accessible for placement of wax thereon.

8. A personal vaporizer as in claim 1, wherein the bowl has side walls that extend from a bowl distal end to the open proximal end, the bowl has a proximal diameter at the open proximal end, and the bowl has a second diameter between the side walls distal of the open proximal end, and the proximal diameter is the same as the second diameter.

9. A personal vaporizer as in claim 8, wherein the second diameter is aligned with the coil.

10. A personal vaporizer, comprising:

an atomizer module comprising a bowl and a heat element arranged in the bowl, a vaporizing chamber defined in the bowl adjacent the heat element;

a tank module selectively attachable to the atomizer module, the tank module comprising a fluid tank configured to contain a vaporizing liquid therewithin, the fluid tank comprising a bottom wall having at least one fluid delivery hole extending therethrough;

a wick holder disposed distal of the fluid tank bottom wall and supporting a wick having a wick proximal end and a wick distal end, a fluid receiver space being defined between the fluid tank bottom wall and the wick proximal end and being in communication with the at least one fluid delivery hole, the wick configured to communicate vaporizing fluid from the fluid receiver space to the wick distal end in the vaporizing chamber; and a vapor tube extending through the fluid tank and defining a vapor passage that is separated from the fluid in the fluid tank;

wherein vapor from the vaporizing chamber is directed through the vapor passage.

11. A personal vaporizer as in claim 10, wherein at least two fluid delivery holes are formed extending through the bottom wall and communicating with the fluid receiver space.

12. A personal vaporizer as in claim 11, wherein a combined cross-sectional area of the at least two fluid delivery holes is less than a cross-sectional area of the vapor passage.

13. A personal vaporizer as in claim 10, wherein a cross-sectional area of the wick is greater than a cross-sectional area of the vapor passage.

14. A personal vaporizer as in claim 10, wherein the wick holder is attached to the fluid tank so that it is part of the tank module.

15. A personal vaporizer as in claim 14, wherein no portion of the wick supported by the wick holder extends into the fluid tank.

16. A personal vaporizer, comprising:

an atomizer module comprising a bowl and a heat element arranged in the bowl, a vaporizing chamber defined in the bowl adjacent the heat element;

a tank module selectively attachable to the atomizer module, the tank module comprising a fluid tank configured to contain a vaporizing liquid therewithin, the fluid tank comprising a bottom wall having at least one fluid delivery hole extending therethrough;

a wick holder disposed distal of the fluid tank bottom wall and supporting a wick and defining a fluid receiver space, the fluid receiver space being between and in communication with the at least one fluid delivery hole and a wick proximal end, the wick configured to communicate vaporizing fluid from the fluid receiver space to wick distal end in the vaporizing chamber;

a vapor tube extending through the fluid tank and defining a vapor passage that is separated from the fluid in the fluid tank; and a transfer member interposed between the wick holder and the fluid tank bottom wall, the wick holder connected to the transfer member so that the fluid receiver space is defined between the wick holder and the transfer member, the transfer member having a secondary fluid delivery hole aligned with the fluid delivery hole of the fluid tank and with the fluid receiver space so that fluid from the fluid tank flows through the fluid delivery hole to and through the secondary fluid delivery hole to the fluid receiver space;

wherein vapor from the vaporizing chamber is directed through the vapor passage.

17. A personal vaporizer as in claim 16, wherein the transfer member additionally comprises a plurality of vapor inlets in communication with the vaporizing chamber, and the vapor tube is attached to the transfer member and in communication with the vapor inlets.

18. A personal vaporizer as in claim 17, wherein the vapor tube is arranged along a longitudinal axis of the tank module.

19. A personal vaporizer as in claim 18, wherein the wick is arranged along a longitudinal axis of the tank module and distal of the vapor tube.

20. A personal vaporizer as in claim 17, wherein the fluid receiver space is distal of the vapor tube and spans a longitudinal axis of the tank module.

* * * * *